US008359799B2

(12) United States Patent
Shapiro et al.

(10) Patent No.: US 8,359,799 B2
(45) Date of Patent: Jan. 29, 2013

(54) BUILDING MODULE, A METHOD FOR MAKING SAME, AND A METHOD FOR USING SAME TO CONSTRUCT A BUILDING

(76) Inventors: Darek Shapiro, Stamford, CT (US); Victor Rolando Yanez Galindo, West Haven, CT (US)

( * ) Notice: Subject to any disclaimer, the term of this patent is extended or adjusted under 35 U.S.C. 154(b) by 0 days.

(21) Appl. No.: 13/026,020

(22) Filed: Feb. 11, 2011

(65) Prior Publication Data

US 2012/0036803 A1 Feb. 16, 2012

Related U.S. Application Data

(60) Provisional application No. 61/337,935, filed on Feb. 12, 2010, provisional application No. 61/405,974, filed on Oct. 22, 2010.

(51) Int. Cl.
*E04B 9/00* (2006.01)

(52) U.S. Cl. ..... 52/345; 52/379; 52/568; 52/426; 52/351

(58) Field of Classification Search ..... 52/379, 52/351, 345, 426, 428, 431, 432, 568, 698
See application file for complete search history.

(56) References Cited

U.S. PATENT DOCUMENTS

| | | | | | |
|---|---|---|---|---|---|
| 3,370,391 | A | | 2/1968 | Dupuis et al. | 52/346 |
| 3,405,493 | A | * | 10/1968 | Omholt | 52/480 |
| 4,050,205 | A | | 9/1977 | Ligda | 52/357 |
| 4,052,831 | A | | 10/1977 | Roberts et al. | 52/309.8 |
| 4,068,429 | A | | 1/1978 | Moore | 52/204 |
| RE29,965 | E | * | 4/1979 | Zinn | 52/243 |
| 4,223,505 | A | | 9/1980 | Krebel et al. | 52/509 |
| 4,342,181 | A | | 8/1982 | Truesdell | 52/743 |
| 4,376,361 | A | | 3/1983 | Michael | 52/241 |
| 4,435,928 | A | | 3/1984 | Huling | 52/90 |
| 4,494,343 | A | | 1/1985 | Berry et al. | 52/309.11 |
| 4,696,139 | A | * | 9/1987 | Kiselewski | 52/426 |
| 4,745,032 | A | | 5/1988 | Morrison | 428/215 |
| 4,964,252 | A | | 10/1990 | Guliker | 52/275 |
| 5,285,009 | A | | 2/1994 | Bowman et al. | 174/48 |
| 5,410,852 | A | | 5/1995 | Edgar et al. | 52/408 |
| 5,440,854 | A | | 8/1995 | Hohmann | 52/489.1 |
| 5,816,008 | A | * | 10/1998 | Hohmann | 52/565 |
| 6,117,375 | A | | 9/2000 | Garrett et al. | 264/46.2 |
| 6,170,213 | B1 | | 1/2001 | Zarrelli et al. | 52/509 |
| 6,226,942 | B1 | | 5/2001 | Bonin | 52/309.12 |

(Continued)

OTHER PUBLICATIONS

International Search Report and Written Opinion dated Apr. 28, 2011 from corresponding PCT/US2011/024599.

(Continued)

*Primary Examiner* — Brian Glessner
*Assistant Examiner* — Brian D Mattei
(74) *Attorney, Agent, or Firm* — Ohlandt, Greeley, Ruggiero & Perle, LLP

(57) ABSTRACT

A building module. The building module has a rigid inner construction panel defining a planar surface thereon; one or more rigid brackets each affixed by one or more mechanical fasteners to the planar surface of the inner construction panel; a rigid, closed-cell, spray foam or adhesive matrix contiguous to and substantially covering the planar surface of the construction panel and filling and surrounding and/or embedding at least a major portion of the one or more brackets. Each of the one or more brackets bears a planar surface facing substantially away from the planar surface of the inner construction panel. The surface area of the planar surface of each of the one or more brackets is substantially smaller than the surface area of the planar surface of the construction panel to which it is affixed. There is also a method for making a building module, a method for constructing a building using the building module, and brackets useful in the building module.

25 Claims, 18 Drawing Sheets

U.S. PATENT DOCUMENTS

| | | | | |
|---|---|---|---|---|
| 6,418,687 | B1 | 7/2002 | Cox | 52/309.4 |
| 6,807,786 | B1 | 10/2004 | Peck | 52/514.5 |
| 7,194,845 | B2 | 3/2007 | Belleau | 52/745.09 |
| 7,249,443 | B2 | 7/2007 | Faulkner et al. | 52/411 |
| 7,288,211 | B2 | 10/2007 | Bogdan et al. | 252/67 |
| 7,805,900 | B2 | 10/2010 | Kelly | 52/309.2 |
| 8,161,699 | B2 * | 4/2012 | LeBlang | 52/309.12 |
| 2005/0244626 | A1 | 11/2005 | Leslie | 428/304.4 |
| 2006/0240243 | A1 | 10/2006 | Leslie | 428/304.4 |
| 2006/0265985 | A1 | 11/2006 | Nichols | 52/309.8 |
| 2007/0214739 | A1 | 9/2007 | Sherner | 52/309.9 |
| 2008/0010920 | A1 | 1/2008 | Andersen | 52/223.13 |
| 2009/0120027 | A1 * | 5/2009 | Amend | 52/426 |

OTHER PUBLICATIONS

IPRP dated Aug. 23, 2012 from corresponding PCT/US2011/024599.

* cited by examiner 300
352
356
354
348
346
342
312
350
344
308
310
301
322
306
336
342
350
334
338
312
342
310
305
307
326
324
307
312
322
303
314
304
322
330
314
350
303
342
316
328
302
310
301
320
350
318
303

BUILDING MODULE, A METHOD FOR MAKING SAME, AND A METHOD FOR USING SAME TO CONSTRUCT A BUILDING

CROSS-REFERENCE TO RELATED APPLICATIONS

The present application claims priority based on U.S. Provisional Application Nos. 61/337,935, filed Feb. 12, 2010 and 61/405,974, filed Oct. 22, 2010, both of which are incorporated herein by reference.

BACKGROUND OF THE DISCLOSURE

1. Field of the Disclosure

The present disclosure relates to a building module. The present disclosure further relates to a method for constructing a building module. The present disclosure also relates to a method for constructing a building using a building module.

2. Description of the Prior Art

There is a need for better methods of construction for conserving energy and preventing air infiltration, condensation, and moisture migration in buildings. It would be desirable to have methods for reducing energy losses associated with existing old and/or poorly designed thermal insulation and leaky building envelopes.

There are methods known in the construction industry for insulating the exteriors of buildings, such as application of foam insulation board followed by application of siding. However, the previous methods do not provide the combination of high strength, high insulation capability, effective air/water barrier, and resistance to moisture buildup.

SUMMARY OF THE DISCLOSURE

According to the present disclosure, there is provided a building module. The building module has a rigid inner construction panel defining a planar surface thereon; one or more rigid brackets each affixed by one or more mechanical fasteners to the planar surface of the construction panel; a rigid, closed-cell, spray foam or an adhesive matrix contiguous to and substantially covering the planar surface of the construction panel and contacting and embedding at least a major portion of the one or more brackets. Each of the one or more brackets bears a planar surface facing substantially away from the planar surface of the construction panel. The surface area of the planar surface of each of the one or more brackets is substantially smaller than the surface area of the planar surface of the construction panel to which it is affixed.

Further according to the present disclosure, there is provided a method for making a building module. The method has the steps of (a) affixing one or more rigid brackets to a planar surface of a rigid inner construction panel by one or more mechanical fasteners and (b) applying a sprayed rigid, closed-cell structural foam (such as a sprayed or foam-in-place foam) or an adhesive contiguous to the construction panel and contacting and surrounding and/or embedding at least a major portion of the one or more brackets. The one or more brackets each bears a planar surface facing substantially away from the planar surface of the construction panel. The surface area of the planar surface of each of the one or more brackets is substantially smaller than the surface area of the planar surface of the construction panel to which it is affixed.

Still further according to the present disclosure, there is provided a method for constructing a building. The method has the step of joining a plurality of the building modules described above.

Still further according to the present disclosure, there is provided an embodiment of a bracket. The bracket includes first and second slidably coextensive unitary components. The first unitary component includes a back panel, a bottom ledge, and first and second side panels. The back panel intersects the first and second side panels at substantially right angles. The first and second side panels intersect the bottom ledge at substantially right angles. The first and second side panels each have an outer surface. The first and second side panels each have a plurality of splines protruding at their outer surface extending generally from top to bottom. The back panel is flush and contiguous with respect to the planar surface of the interior construction panel. The back panel is affixed to the planar surface of the interior construction panel. The second unitary component has a face panel, third and fourth side panels, and a rim. The face panel intersects the third and fourth side panels at substantially right angles. The rim extends around the upper edges of the outer panel and the third and fourth side panels. The face panel bears the planar surface of each of the one or more brackets. The third and fourth side panels each have an inner surface. The third and fourth side panels each have a plurality of splines protruding at their inner surface extending generally from top to bottom. The plurality of splines of the first and second side panels is slidably coextensive with the splines of the third and fourth side panels.

Still further according to the present disclosure, there is provided another embodiment of a bracket. The bracket has a platform bearing a planar surface, four legs appending substantially equilaterally from the platform away from the planar surface, and at least one fastening tab appending from each of the four legs. The at least one fastening tab is actuatable with respect to the leg from which it appends. The platform and the legs are formed from metal sheet defining a plurality of orifices therein and therethrough substantially over the entirety thereof.

Still further according to the present disclosure, there is provided another embodiment of a bracket. A bracket has a first component and a second component. The first component includes a first platform bearing a first planar surface and first and second side panels. The first and second panels are generally parallel with respect to each other and that append generally perpendicularly from the first platform and away from the first planar surface. The first and second side panels define first and second groups of protrusions along their respective leading edges. The first and second groups of protrusions extend generally perpendicularly from the first and second side panels, respectively, and extend away from each other. The first component is formed from flexible metal sheet defining a plurality of orifices therein and therethrough substantially over the entirety of the flexible metal sheet. The second component includes a second platform bearing a second planar surface and third and fourth side panels. The third and fourth side panels are generally parallel with respect to each other and append generally perpendicularly from the second platform and away from the second planar surface. The third and fourth side panels define third and fourth groups of protrusions along their respective leading edges. The third and fourth groups of protrusions extend generally perpendicularly from the third and fourth side panels and extend generally away from each other. The second component is formed from flexible metal sheet defining a plurality of orifices therein and therethrough substantially over the entirety of the flexible metal sheet. The first component is inserted a desired distance into the second component such that the first and second groups of protrusions interlock with orifices through inner surfaces of the third and fourth sides, respectively.

Further according to the present disclosure, there is provided a building module. The module has an inner construction panel defining a planar surface thereon, one or more rigid brackets each affixed by one or more mechanical fasteners to the planar surface of the construction panel, and an exterior panel affixed to the planar surface of each of the one or more brackets. Each of the one or more brackets bears a planar surface facing substantially away from the planar surface of the construction panel. The surface area of the planar surface of each of the one or more brackets is substantially smaller than the surface area of the planar surface of the construction panel to which the one or more brackets is affixed. The one or more brackets is substantially free of a rigid structural foam or an adhesive matrix, wherein the one or more brackets is the one or more brackets set forth in any of claims 24, 25, and 28.

DETAILED DESCRIPTION OF THE DISCLOSURE

Figure 1A:
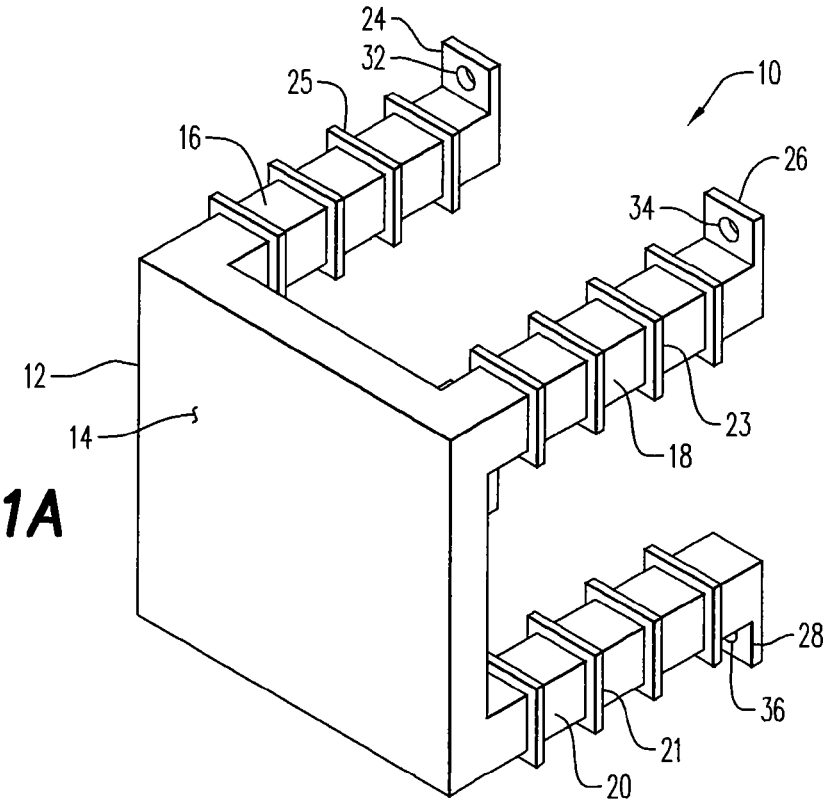
FIG. 1A is a first perspective view of a bracket useful in a building module according to the present disclosure.
Figure 1B:
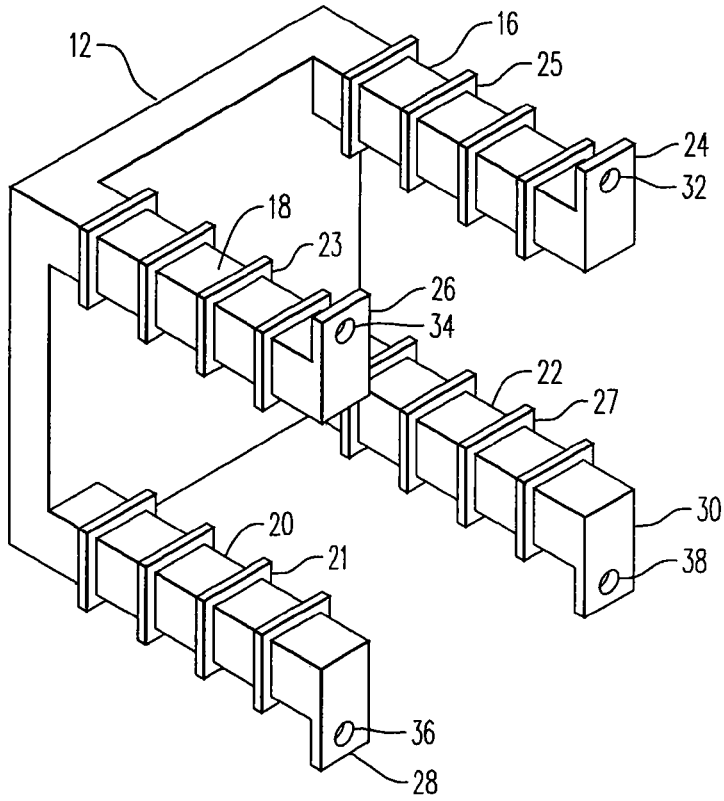
FIG. 1B is a second perspective view of the bracket shown FIG. 1A.

A bracket useful in the building module of the present disclosure is depicted in FIGS. 1A and 1B and generally referenced by the numeral 10. Bracket 10 has a platform 12 that bears a planar surface 14. Bracket 10 has legs 16, 18, 20, and 22 extending away from planar surface 14. Legs 16, 18, 20, and 22 have protruding fins 21, 23, 25, and 27, which act to further immobilize bracket 10 in a foam or adhesive matrix. Legs 16, 18, 20, and 22 define fastening tabs 24, 26, 28, and 30, respectively, through which bracket 10 can be affixed to an inner construction panel (not shown) through orifices 32, 34, 36, and 38, respectively, by means of mechanical fasteners (not shown).

Figure 2A:
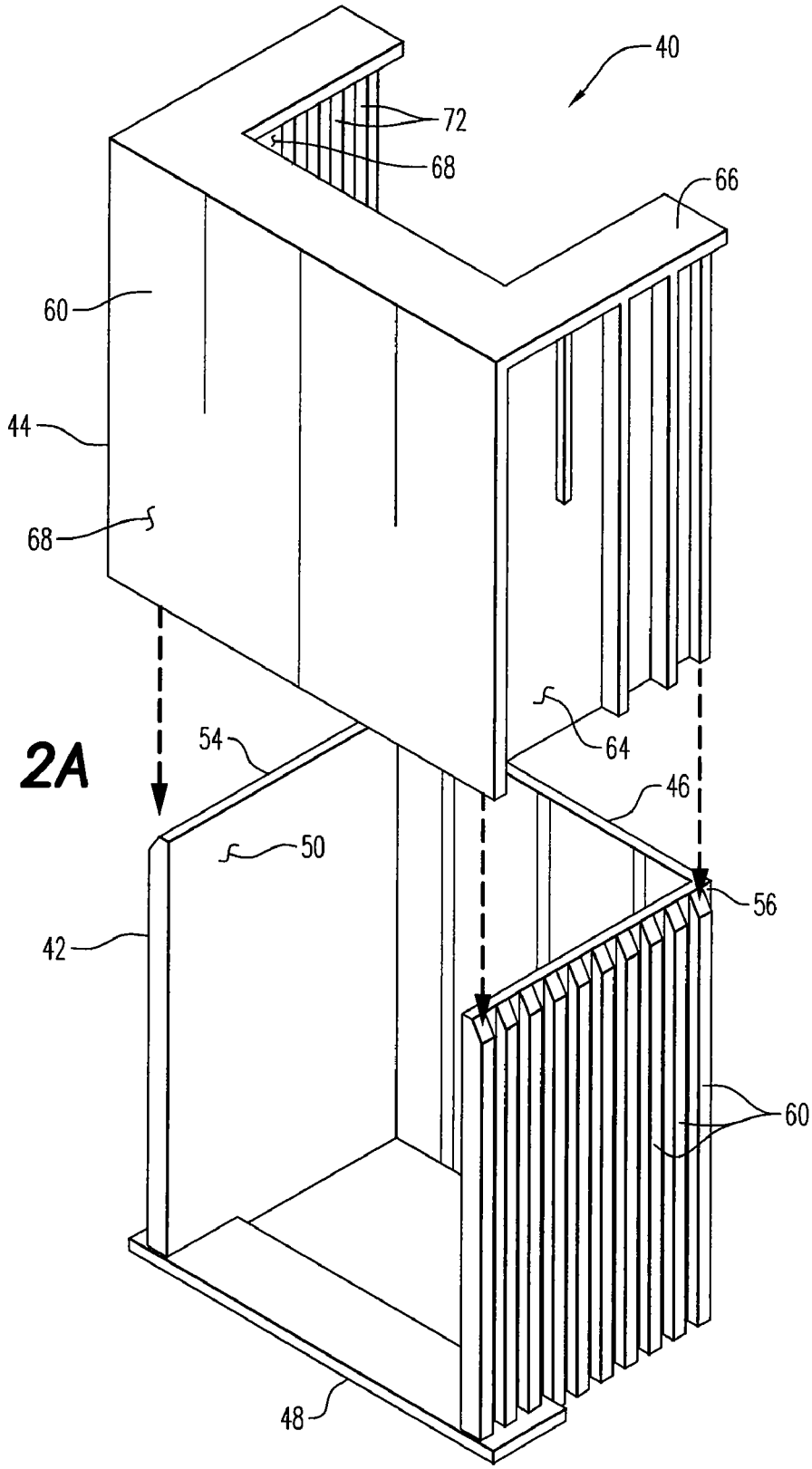
FIG. 2A is a first perspective, exploded view of another embodiment of a bracket useful in a building module according to the present disclosure.
Figure 2B:
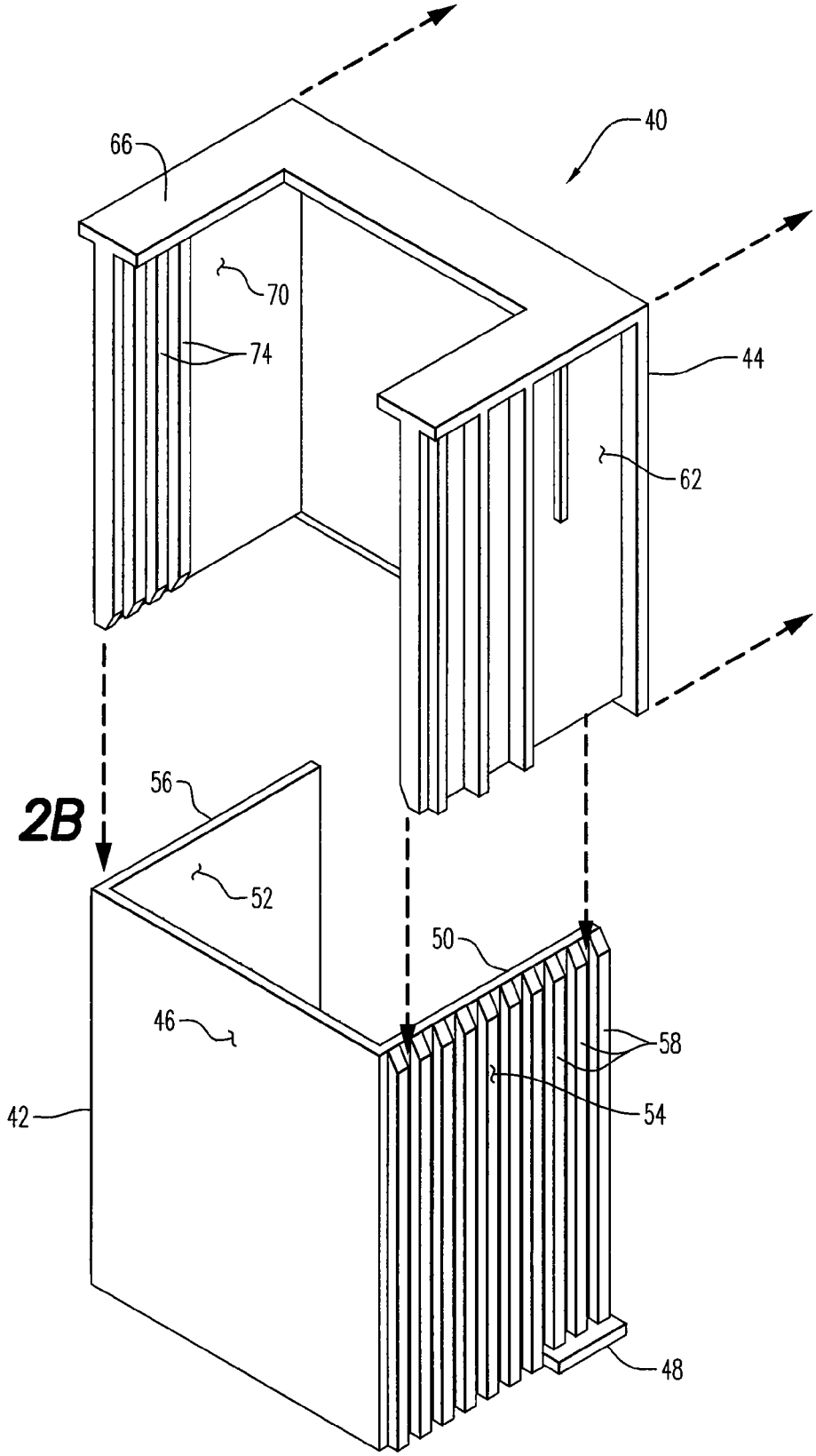
FIG. 2B is a second perspective, exploded view of another embodiment of the bracket shown in FIG. 2B.

Another embodiment of a bracket useful in the building module of the present disclosure is depicted in FIGS. 2A and 2B and generally referenced by the numeral 40. Bracket 40 has first and second components 42 and 44. Components 42 and 44 are each preferably unitary in construction and are slidably coextensive, i.e., may be slid one into the other.

Components 42 and 44 are preferably of an injected molded plastic, e.g., acrylonitrile-butadiene-styrene (ABS), polypropylene, and polycarbonates. Base component 42 has a back panel 46, a bottom ledge 48, and first and second side panels 50 and 52. Back panel 46 intersects side panels 50 and 52 at substantially right angles. Side panels 50 and 52 intersect bottom ledge 48 at substantially right angles. There is open space between ledge 48 and back panel 46 along the bottom of side panels 50 and 52; thus, base component 42 is partially open along its bottom. Side panels 50 and 52 have outer surfaces 54 and 56, respectively. Side panels 50 and 52 have pluralities of splines 58 and 60 (groups of splines), respectively, protruding from outer surfaces 54 and 56, respectively. Splines 58 and 60 extend generally from top to bottom of side panels 50 and 52, respectively. The width of individual splines with the groups of splines 58 and 60 taper outward slightly as splines 58 and 60 course upward along outer surfaces 54 and 56. The tapering outward creates a self-tightening assembly between base component 42 and cap component 44. Back panel 46 is adapted to contact and be positioned flush with and affixed to a surface of an inner construction panel (not shown), Cap component 44 has a face panel 60, third and fourth side panels 62 and 64, and a rim 66. Face panel 60 intersects third and fourth side panels 62 and 64 at substantially right angles.

Rim 66 extends around the upper edges of outer panel 60 and side panels 62 and 64. Face panel 60 bears a planar surface 68 adapted to receive, contact, and be flush with and affixed to exterior sheathing, panels, or masonry (not shown). Side panels 62 and 64 have inner surfaces 68 and 70, respectively. Side panels 62 and 64 have pluralities of splines 72 and 74 (two groups), respectively, protruding inward from inner surfaces 68 and 70, respectively. Splines 72 and 74 extend generally from top to bottom of side panels 62 and 64, respectively. The width of individual splines within the groups of splines 72 and 74 taper inward slightly as splines 72 and 74 course downward along inner surfaces 68 and 70. The tapering inward creates a self-tightening assembly between base component 42 and cap component 44. Splines 58 and 60 of component 42 are slidably coextensive with splines 72 and 74 of cap component 44.

An advantage of bracket 40 of FIGS. 2A and 2B is that its adjustability allows use of uneven surfaces and dissimilar materials. An installer can adjust the distance face panel 60 is from the surface of any existing uneven or out-of-plumb wall, construction panel, floor, roof or other planar construction material or curved structural surface. This is accomplished by attaching the bracket base, e.g., component 42 at back panel 46 to the construction surface using fasteners or adhesives, sliding the bracket cap, e.g., component 44, off of component 42, and reinserting it into the component 42 when the outside face of the component 42 is in proper alignment. Alignment can be achieved, for example, through the use of a level, a laser alignment tool, or other alignment tool. Bracket 40, when properly aligned, will then provide an aligned structure adapted to receiving new exterior sheathing or panel materials.

Figure 3:
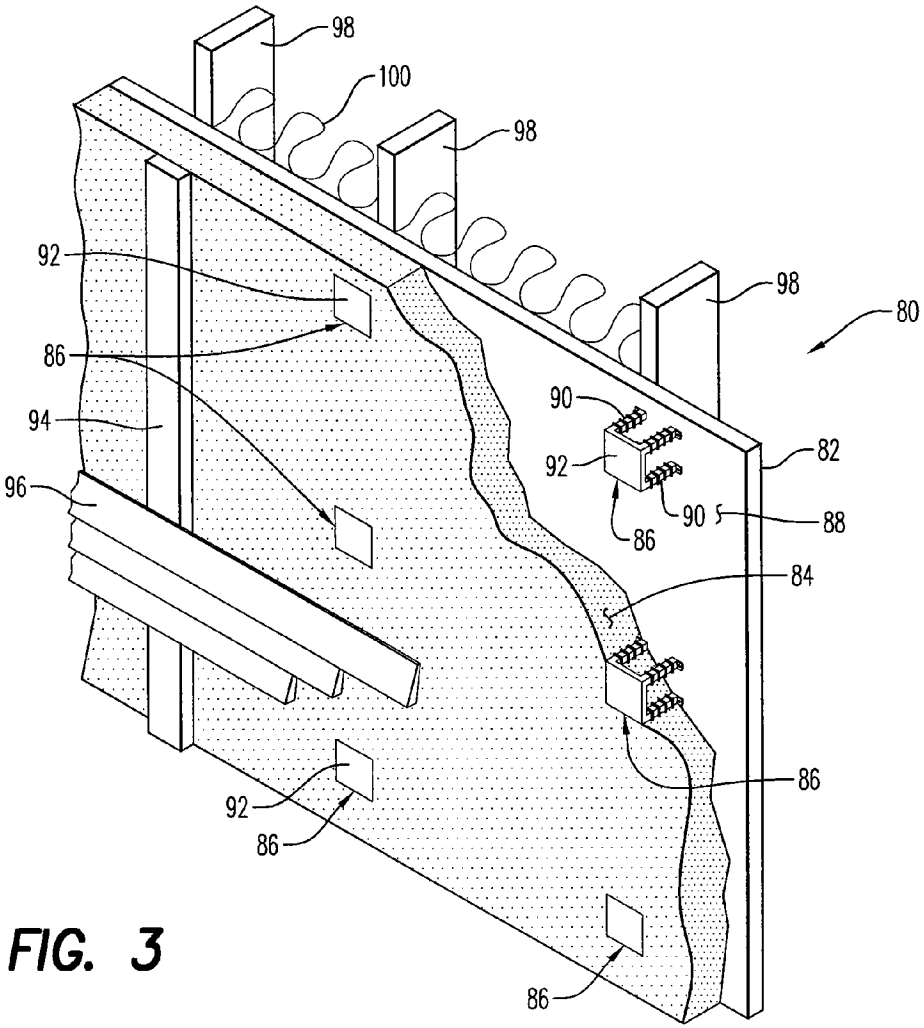
FIG. 3 is a perspective, cutaway view of a building module according to the present disclosure utilizing brackets of the type set forth in FIG. 1.

An embodiment of a building module according to the present disclosure is depicted in FIG. 3 and generally reference by the numeral 80. Module 80 has a rigid inner construction panel 82 defining a planar surface 88. Panel 82 has a plurality of rigid brackets 86 each with four legs 90 affixed to planar surface 88 by screws (not shown) through fastening tabs (not shown) on legs 90. Brackets 86 define planar surfaces 92 thereon. A rigid, spray foam 84 is contiguous to and substantially covering planar surface 88 of panel 82 and contacting and embedding brackets 86 except for planar surfaces 92. Exterior sheathing is shown by way of representation in the form of vertically disposed wood plank 94 affixed to brackets 86 underneath plank 94 via screws (not shown) and horizontally disposed siding 96 attached to plank 94 via screws (not shown). The embodiment has ancillary structure in the form of studs 98, to which panel 82 is affixed, and batt insulation 100 between studs 98.

Figure 4:
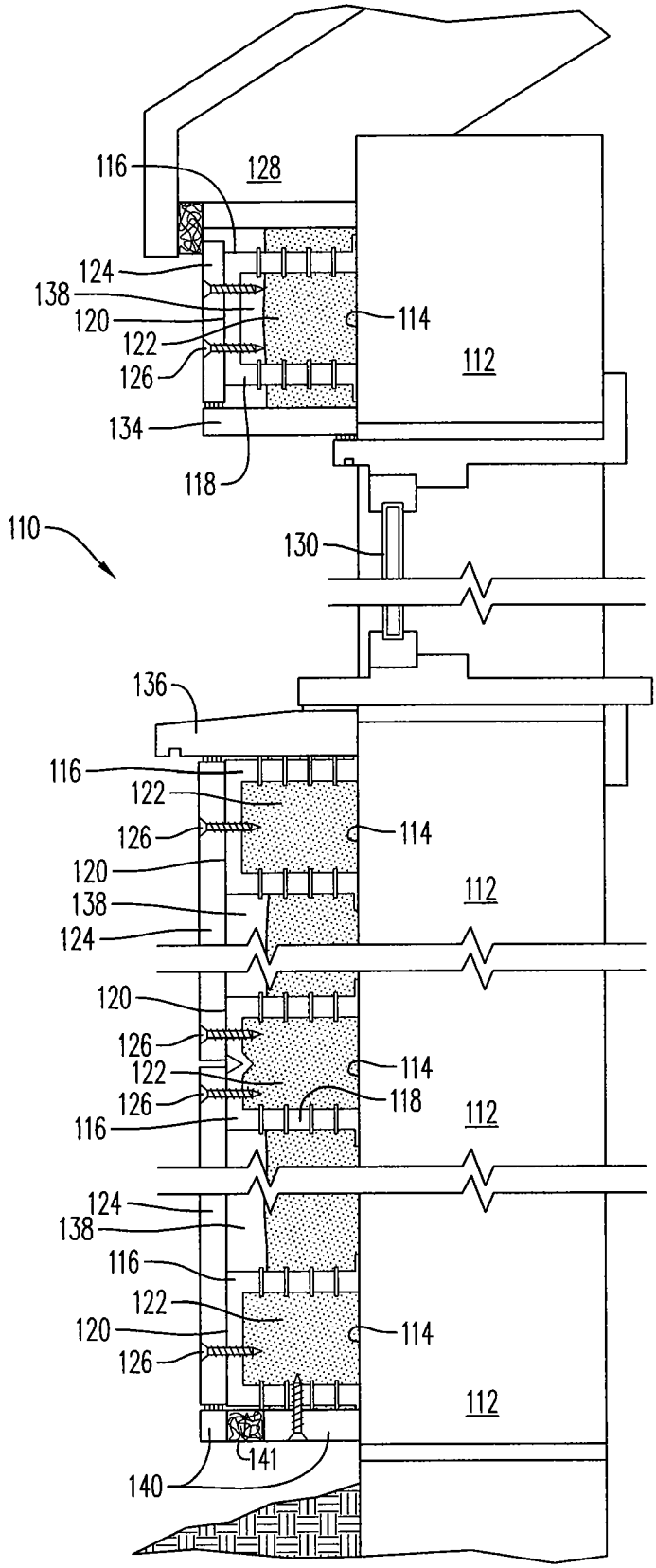
FIG. 4 is a broken, vertical section view of another embodiment of a building module according to the present disclosure utilizing a plurality of the bracket of the type set forth in FIG. 1.

An embodiment of a building module according to the present disclosure is depicted in FIG. 4 in the form of a vertical wall section and generally reference by the numeral 110. Module 110 has a rigid wall 112 defining a planar surface 114. Wall 112 has a plurality of rigid brackets 116 each with four legs 118 affixed to planar surface 114 by screws (not shown). Brackets 116 define planar surfaces 120 thereon. A rigid, spray foam 122 is contiguous to and substantially covering planar surface 114 of wall 112 and contacting and surrounding brackets 116 except for planar surfaces 120. The gaps between foam 122 and exterior panel 124 take the form of airspaces 138, which function as a rainscreen by providing a substantially continuous airspace to vent 141. Exterior sheathing is shown by way of representation in the form of vertically disposed panel 124 affixed to brackets 116 via screws 126 or adhesive (not shown). There is additional structure shown in FIG. 4 in the form of roof structure 128, window 130, head and sill barriers 134 and 136, and base soffit barrier 140.

Figure 5:
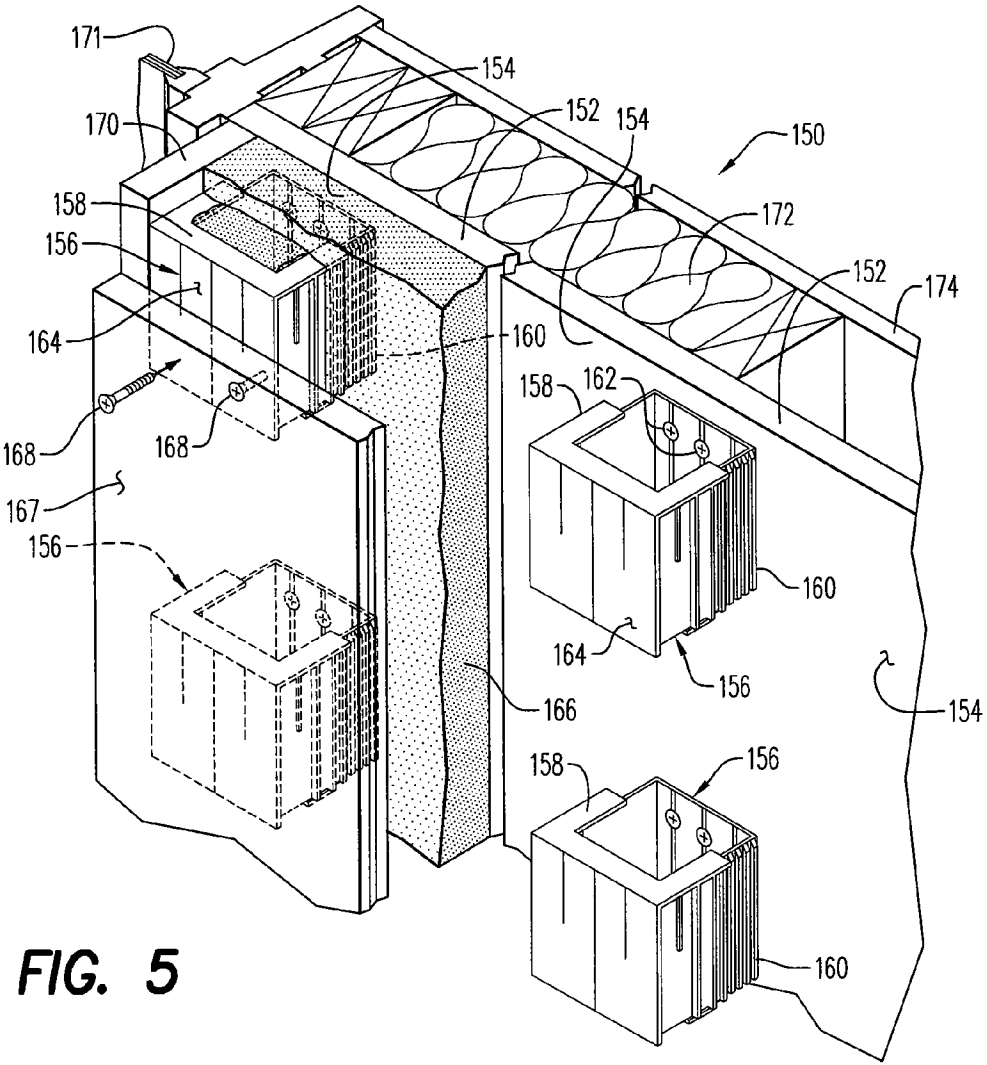
FIG. 5 is a broken, perspective plan section view of another embodiment of a building module according to the present disclosure utilizing a plurality of the bracket of the type set forth in FIG. 2.

An embodiment of a building module according to the present disclosure is depicted in FIG. 5 and generally reference by the numeral 150. Module 150 has an inner panel 152 defining a planar surface 154. Panel 152 has a plurality of rigid brackets 156 each having slidably coextensive cap component 158 and base component 160. Brackets 156 are of the type depicted in FIG. 2. Base components 160 are affixed to planar surface 154 by screws 162. Cap components 158 define planar surfaces 164 thereon. A rigid, spray foam 166 is contiguous to and substantially covering planar surface 154 of panel 152 and contacting and embedding brackets 156 except for planar surfaces 164. Module 150 has a panel of new exterior panels 167 affixed to brackets 156 via screws 168 or adhesive (not shown). There is additional structure shown in FIG. 5 in the form of window extension casing 170, window 171, batt insulation 172, and interior panel 174.

Figure 6:
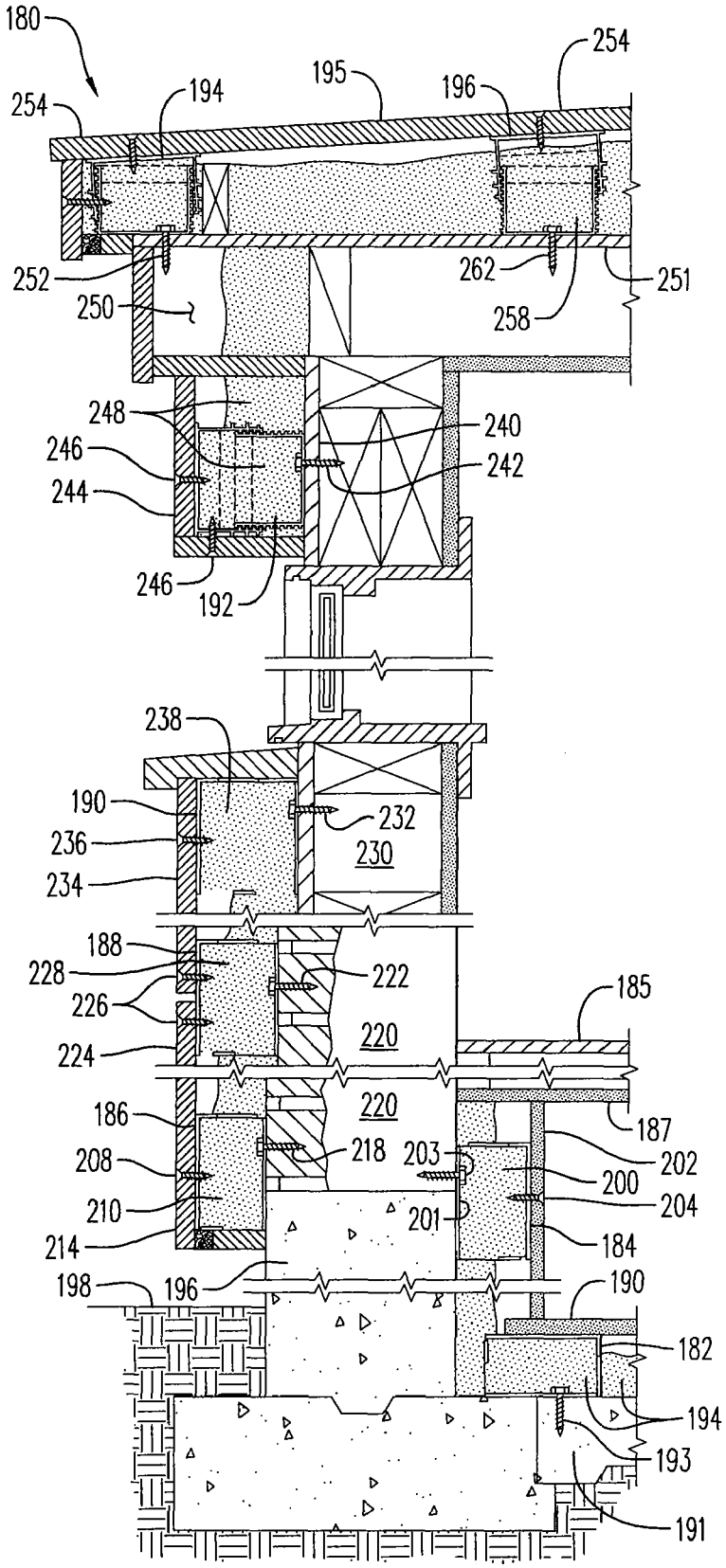
FIG. 6 is a broken, vertical section view of another embodiment of a building module according to the present disclosure utilizing a plurality of the bracket of the type set forth in FIG. 2.

An embodiment of a building module according to the present disclosure is depicted in FIG. 6 and generally reference by the numeral 180. Module 180 has eight different configurations of brackets in the form of brackets 182, 184, 186, 188, 190, 192, 194, and 196. The several brackets are of the type depicted in FIG. 2. The several brackets are affixed with various types of screws to planar or uneven surfaces of various construction materials. Bracket 182 elevates, levels, and insulates a floor 190 above a basement slab 191 and is affixed to slab 191 with a screw 193. Insulation and waterproofing is provided by spray foam 194. Bracket 184 is affixed to an interior basement wall 201 with a screw 203. Bracket 184 insulates and waterproofs a foundation wall 196 below or above external grade 198. There is adjacent structure in the form of floor 185 and ceiling 187. Insulation and waterproofing is provided by spray foam 200. Bracket 186 is affixed to wall 220 with a screw 218 and exterior panel 214 is attached to bracket 186 with a screw 208. Insulation is provided by spray foam 210. Bracket 188 is adjusted deeper and affixed to an uneven masonry-surfaced wall 220 with a screw 222 and exterior panel 224 with screws 226 on each side of panel joint. Insulation is provided by spray foam 228. Bracket 190 is affixed to a wood wall 230 with a screw 232 and exterior sheathing 234 with a screw 236. Bracket 190 is actuated deeper to match changes in the existing exterior surface building of module 180 at wall 230. Insulation is provided by spray foam 238. Bracket 192 is affixed to a wall 240 with a screw 242 and exterior panel 244 with screws 246. Bracket 192 is oriented sideways due to lack of clearance to slide the bracket cap down from above. Insulation is provided by spray foam 248. Bracket 194 is secured to a roof joist 250 with a screw 252. Roof sheathing 254 is secured to bracket 194 with uneven (angled) bracket cap spline engagement with base piece to create pitch. Insulation is provided by foam 258. Bracket 196 is secured to a roof sheathing 251 and, if desired, roof joist 250 with a screw 262 and roof 254. Sheathing is attached to bracket 196 with angled engagement and wider gap than bracket 194 to continue pitch. Insulation is provided by spray foam 258. Air space 255 above foam 258 provides roof ventilation from inlet 253 providing a "cold roof" assembly.

Figure 7:
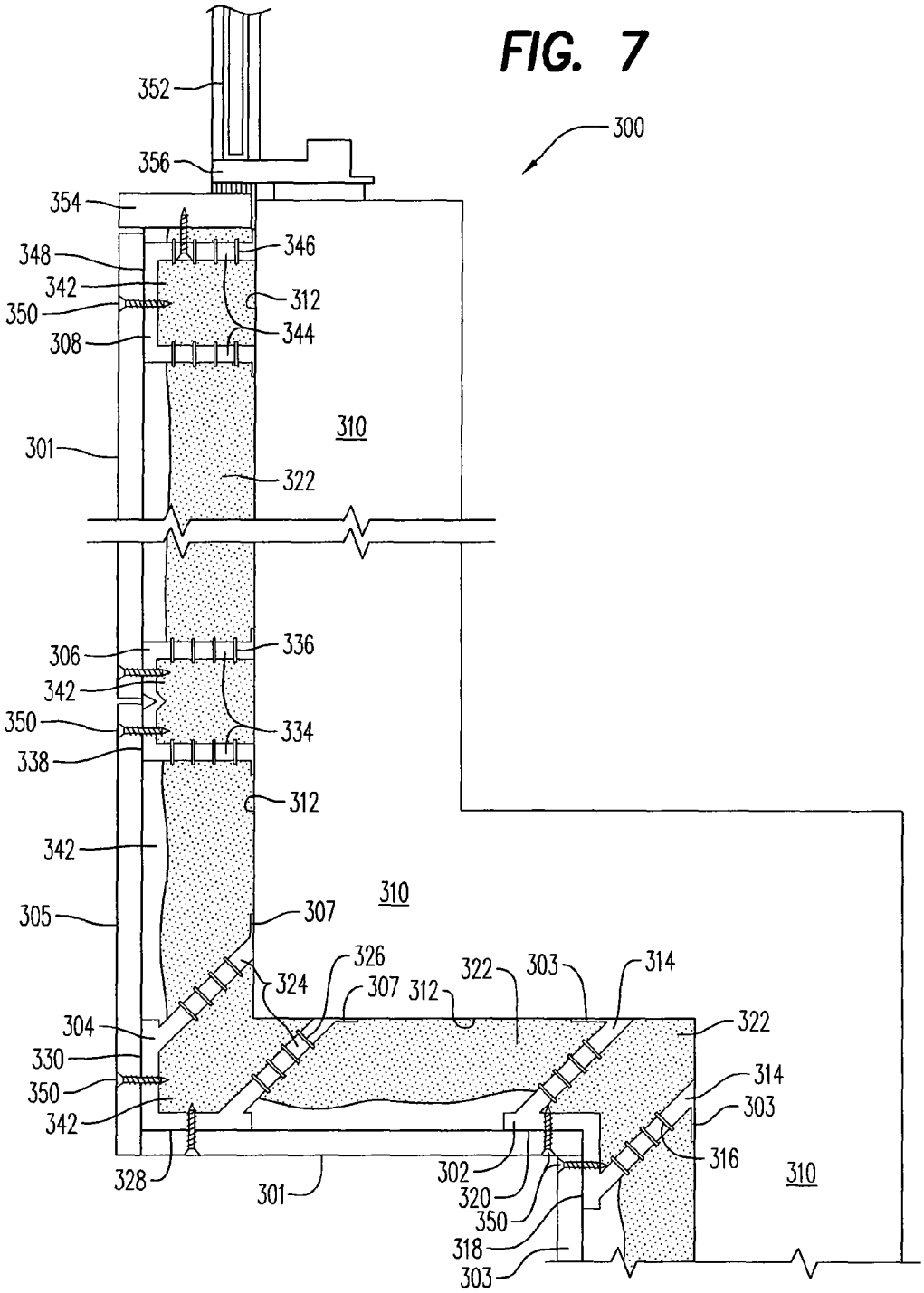
FIG. 7 is a broken, plan section view of another embodiment of a building module according to the present disclosure utilizing a plurality of the bracket of the type set forth in FIG. 1.

An embodiment of a building module according to the present disclosure is depicted in FIG. 7 and generally reference by the numeral 300. Module 300 has different configurations of brackets in the form of brackets 302, 304, 306, and 308. Brackets 302, 304, 306, and 308 are of the type generally depicted in FIG. 1. Brackets 302, 304, 306, and 308 are adapted to receiving and being affixed to exterior panels 301, 303, and 305. Module 300 has a rigid wall 310 defining a planar surface 312. Bracket 302 has legs (four) 314 each with a plurality of fins 316 and planar surfaces 318 and 320 to provide inside corner support for exterior panels 301 and 303, which are affixed to it. Legs 314 are secured to wall 310 via a plurality of fastening tabs 303 affixed thereto with screws (not shown). Bracket 304 has legs (four) 324 each with a plurality of fins 326 and planar surfaces 328 and 330. Bracket 304 forms an outside corner support for exterior panels 301 and 305. Legs 324 are secured to wall 310 via a plurality of fastening tabs 307 affixed thereto with screws (not shown). Bracket 306 has legs (four) 334 each with a plurality of fins 336 and a planar surface 338. Legs 334 are secured to wall 310 via a plurality of fastening tabs (not shown) affixed thereto with screws (not shown). Bracket 308 has legs (four) 344 each with a plurality of fins 346 and a planar surface 348. Legs 344 are secured to wall 310 via a plurality of fastening tabs (not shown) affixed thereto with screws (not shown).

A rigid, spray foam 322 is contiguous to and substantially covering planar surface 312 of wall 310 and contacting and surrounding brackets 302, 304, 306, and 308 except for planar surfaces 318, 320, 328, 330, 338, and 348. The gaps between foam 322 and exterior panels 301 and 303 take the form of airspaces 342, which may also act as a rainscreen, if desired. Exterior panels are affixed to brackets 302, 304, 306, and 308 via a plurality of screws 350. There is additional structure shown in FIG. 7 in the form of window 352, extension window casing 354, and window jamb 356.

Figure 8:
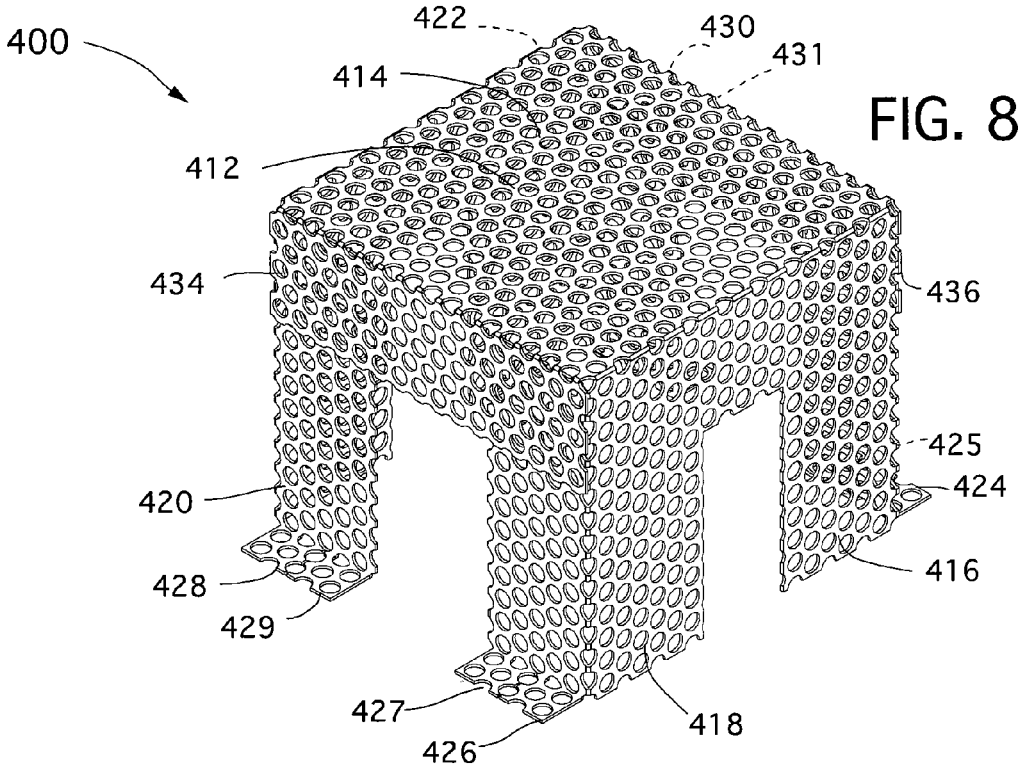
FIG. 8 is a perspective view of another embodiment of a bracket useful in a building module according to the present disclosure.
Figure 9:
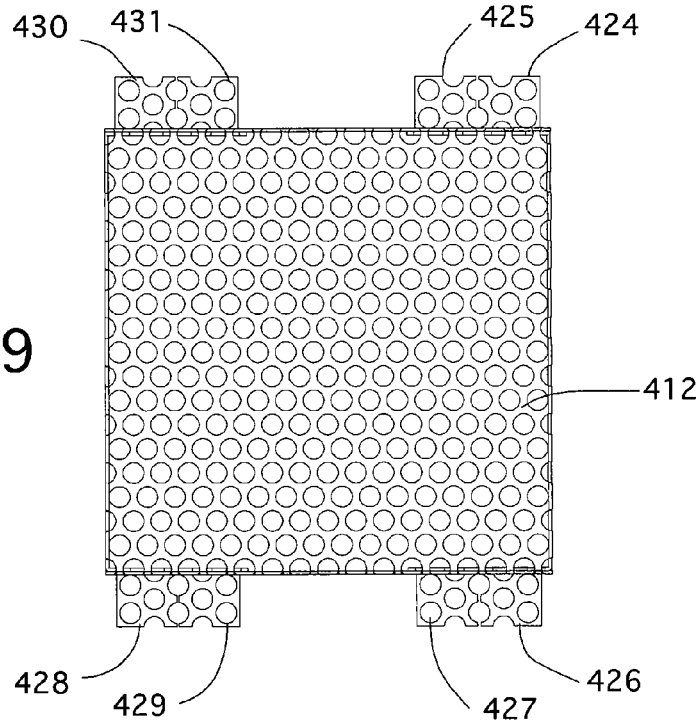
FIG. 9 is a plan view of the bracket of FIG. 8.

Another bracket useful in the building module of the present disclosure is depicted in FIGS. 8 and 9 and generally referenced by the numeral 400. Bracket 400 is constructed entirely of a perforated metal, such as galvanized or stainless steel or other rigid structural material, and is preferably formed from a single, integral piece of perforated sheet metal (not shown). The perforations therein take the form of a plurality of orifices therein and therethrough. Bracket 400 has a platform 412 that bears a perforated planar surface 414. Bracket 400 has overlap members 434 and 436 that are preferably integral to platform 412 and provide additional strength and rigidity to bracket 400. Bracket 400 has legs 416, 418, 420, and 422 appending substantially equilaterally from platform 412 and extending away from planar surface 414. Leg 416 has fastening tabs 424 and 425. Fastening tabs 424 and 425 are adjacent but not interconnected. Leg 418 has fastening tabs 426 and 427. Fastening tabs 426 and 427 are adjacent but not interconnected. Leg 420 has fastening tabs 428 and 429. Fastening tabs 428 and 429 are adjacent but not interconnected. Leg 422 has fastening tabs 430 and 431. Fastening tabs 430 and 431 are adjacent but not interconnected. Fastening tabs are preferably flexible yet exhibit deadfold with respect to the legs from which they append and can be actuated independently of each other and positioned differently with respect to construction surfaces to which the bracket may be attached. Bracket 400 can be affixed to an inner construction panel (not shown) through orifices in the fastening tabs by means of mechanical fasteners, such as screws, nails, and staples (not shown), or by adhesives.

Figure 10:
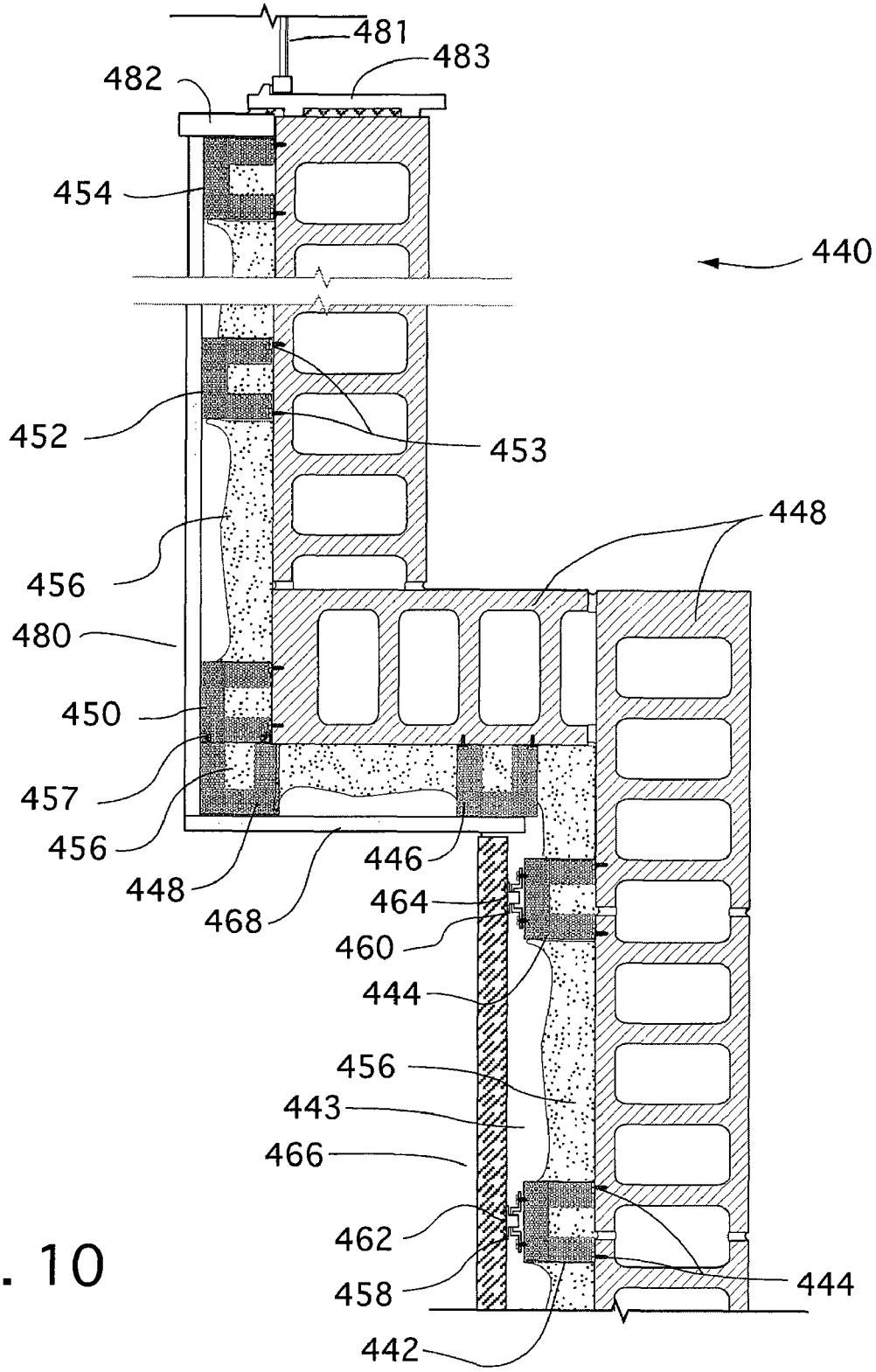
FIG. 10 is a broken, plan view of an embodiment of a building module according to the present disclosure utilizing a plurality of the bracket of the type set forth in FIG. 8.

An embodiment of a building module according to the present disclosure is depicted in FIG. 10 and generally reference by the numeral 440. Module 440 has a rigid wall of a plurality of concrete blocks 448. Module 440 has a plurality of rigid brackets 442, 444, 446, 448, 450, 452, and 454 affixed to the concrete block wall via a plurality of screws 453 through orifices in their respective fastening tabs. The several brackets are of the type and structure depicted in FIG. 9. A rigid, spray foam 456 embeds at least a major part of the depth of brackets 442, 444, 446, 448, 450, 452, and 454. The gaps between foam 456 and exterior panels 466, 468, and 480 take the form of airspaces 443, which function as a rainscreen behind by providing ventilation behind the exterior panels. Exterior panel 466 is affixed to brackets 442 and 444 via male latches 462 and 464, which mate with female grooves 458 and 460 affixed to brackets 442 and 444. Bracket 448 is attached to bracket 450 in order to form the outside corner. The fastening tab from bracket 448 is bent horizontal so it can be affixed to top corners of bracket 450 with screw 457 and other screws. Spray foam 456 then embeds and reinforces the outside corner. There is additional structure shown in FIG. 10 in the form of window 481, window jamb 483, and extension casing barrier 482.

Figure 11:
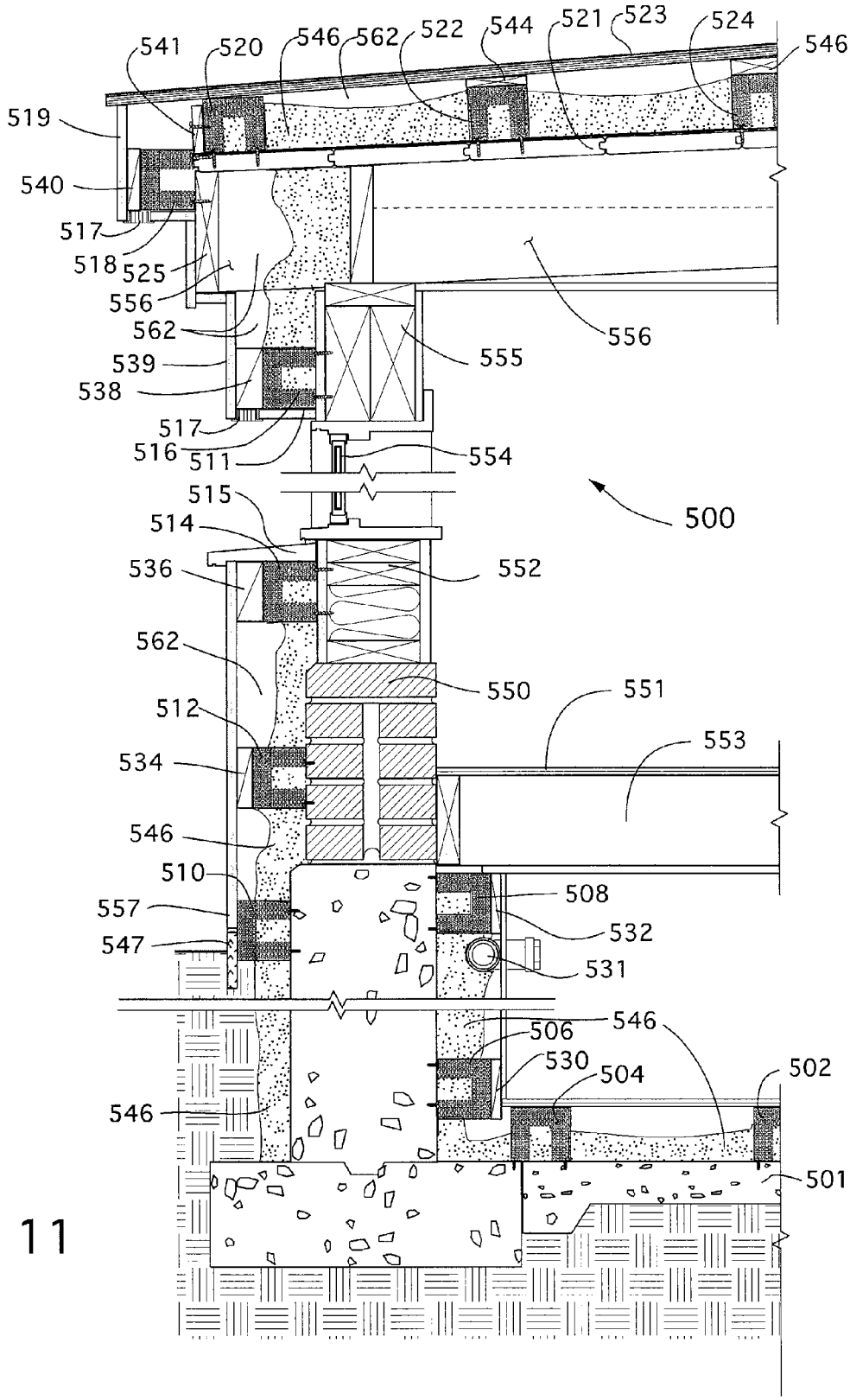
FIG. 11 is a broken, vertical section view of another embodiment of a building module according to the present disclosure utilizing a plurality of the bracket of the type set forth in FIG. 8.

An embodiment of a building module according to the present disclosure is depicted in FIG. 11 and generally referenced by the numeral 500. Module 500 has brackets 502, 504, 506, 508, 510, 512, 514, 516, 518, 520, 522, and 524. The several brackets are of the type depicted in FIG. 8. The several brackets are affixed with various types of screws to planar or uneven surfaces of various construction materials. Brackets 502 and 504 elevate, level, and insulate a floor above a basement slab 501 and are affixed to slab 501 via screws. Insulation and waterproofing is provided throughout module 500 by spray foam 546. Bracket 510 is secured to a cement foundation via screws and provides support for an external panel 557 and a flexible rubber subgrade panel 547. Bracket 512 is secured to masonry 550 via screws and provides support for panel 557 in conjunction with block 534, which allows alignment of external panel 557 from bracket 512. Bracket 514 is secured to block 552 via screws and window sill 515 is fastened to bracket 514 with construction adhesive fastened laterally to window sill 515. Bracket 514 provides support for external panel 557 in conjunction with block 536. Bracket 516 secured to header 555 provides support for external panel 539 in conjunction with block 538 and is used to provide adjustment in bracket depth. Bracket 516 is also secured to and provides lateral support for soffit panel 511. Bracket 520, 522, and 524 are first secured to a roof sheathing 521 and roof panel 523 is attached to bracket 520, 522, and 524. Brackets 522 and 524 have blocks 544 and 546 to provide angled displacement with respect to roof 521. Block 541 is affixed to roof bracket 520 via a screw and is used to keep foam out of the interface between roof panel 523 and roof bracket 520. Bracket 518 is secured to roof rim joist 525 and roof joist 556 and provides support for roof fascia panel 519 in conjunction with block 540. Vent 517 provides ventilation to the roof structure above foam 546 providing "a cold roof". Building module 500 also shows a window 554 in fragment, a floor 551, a floor joist 553, and a plumbing pipe 531.

Figure 12:
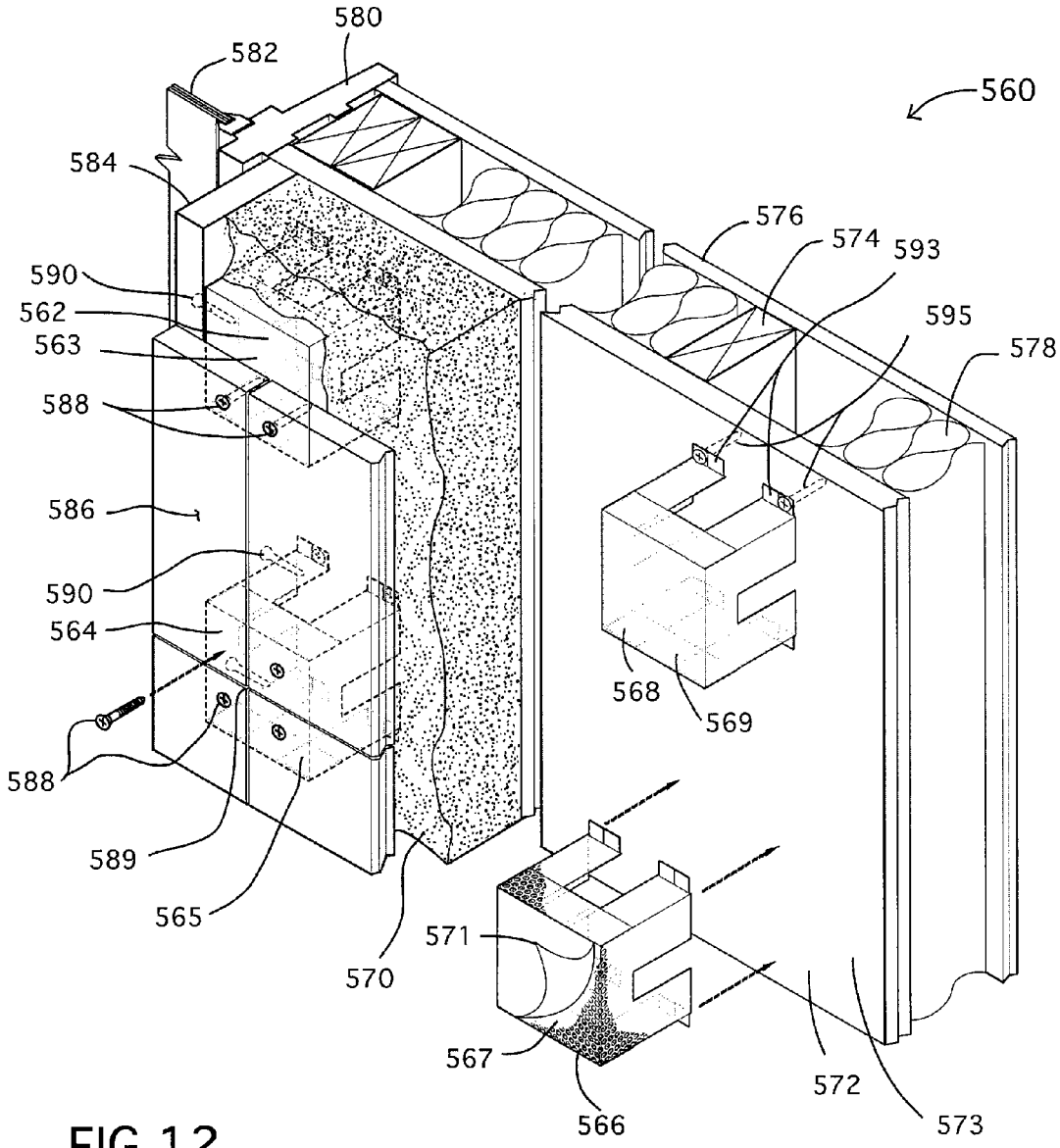
FIG. 12 is a broken, perspective view of yet another embodiment of a building module according to the present disclosure utilizing a plurality of the bracket of the type set forth in FIG. 8.

An embodiment of a building module according to the present disclosure is depicted in FIG. 12 and generally reference by the numeral 560. Module 560 has a rigid inner construction panel 572 defining a planar surface 573. Panel 572 has a plurality of rigid brackets 562, 564, 566, and 568, each of which is affixed to planar surface 573 by screws through fastening tabs on the legs, such as by way of example with screws 595 through fastening tabs 593 in bracket 568. The remaining brackets have corresponding fastening tabs and screws. Exterior construction panel 586 is shown in fragment as affixed to brackets 562 and 564 via screws 588. Panel 586 is also shown in four discrete sections with a point of intersection at 589. Bracket 562 has a side construction panel 584 affixed to it via screws 590. Bracket 562, 564, 566, and 568 correspond in type and structure to bracket 400 in FIG. 8. The four brackets shown are merely illustrative of the number of brackets that can be employed. Fewer or greater numbers of brackets are possible depending on the application. Brackets 562, 564, 567, and 568 define planar surfaces 563, 565, 565, and 569 thereon, respectively, which are adapted to receive panel 586. Bracket 566 shows by way of example the perforated structure of all of the brackets. A rigid, spray foam 570 is contiguous to and substantially covers planar surface 573 of inner panel 572 and contacts and embeds brackets 562, 564, 566, and 568 except for planar surfaces 563, 565, 565, and 569. Bracket 566 also shows by way of example a release or adhesive liner 571, which can be peeled to expose planar surface 567. Liner 571 protects planar surface 567 from being covered over or impinged by foam 570 when foam 570 is applied to planar surface 573. As an alternative to or in addition to a liner, a sheet-like barrier of a paper-based or plastic material can be placed within a bracket on the underside of the planar surface thereof. The embodiment has ancillary structure in the form of interior construction panel 576, studs 574, batt insulation 578, window jamb 580, and window 582.

Figure 13:
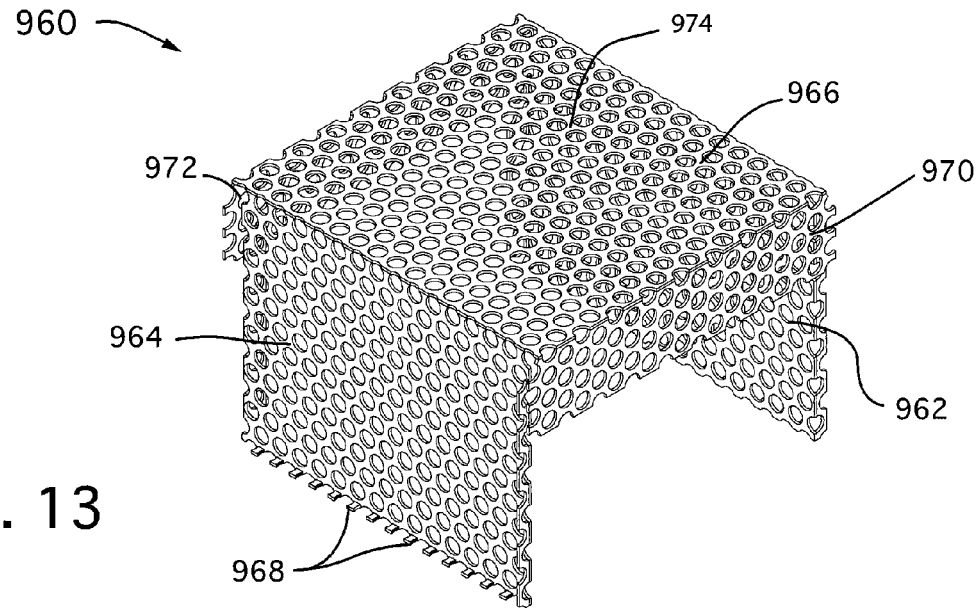
FIG. 13 is a first perspective view of a component of a bracket useful in a building module according to the present disclosure.
Figure 14:
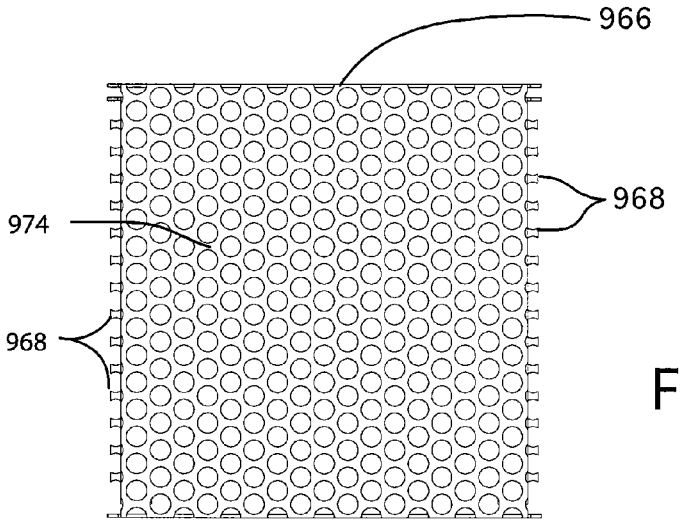
FIG. 14 is a plan view of the component of FIG. 13.

A bracket component useful in forming a bracket useful in a building module of the present disclosure is depicted in FIGS. 13 and 14 and generally referenced by the numeral 960. Bracket component 960 is constructed entirely of a flexible perforated metal, such as galvanized or stainless steel, and is preferably formed from a single, integral piece of perforated metal (not shown). The perforations therein take the form of a plurality of orifices therein and therethrough. Bracket component 960 has a first platform 966 that bears a perforated first planar surface 974. Bracket component 960 has first and second overlap members 970 and 972 that are preferably integral to platform 966 and provide additional strength and rigidity to bracket 960. Bracket component 960 has first and second sides 962 and 964 appending generally perpendicularly from platform 966 and extending away from first planar surface 974. Sides 962 and 964 define first and second groups of protrusions 968, respectively, extending generally perpendicularly therefrom. The first and second groups of protrusions 968 extend generally away from each other.

Figure 15:
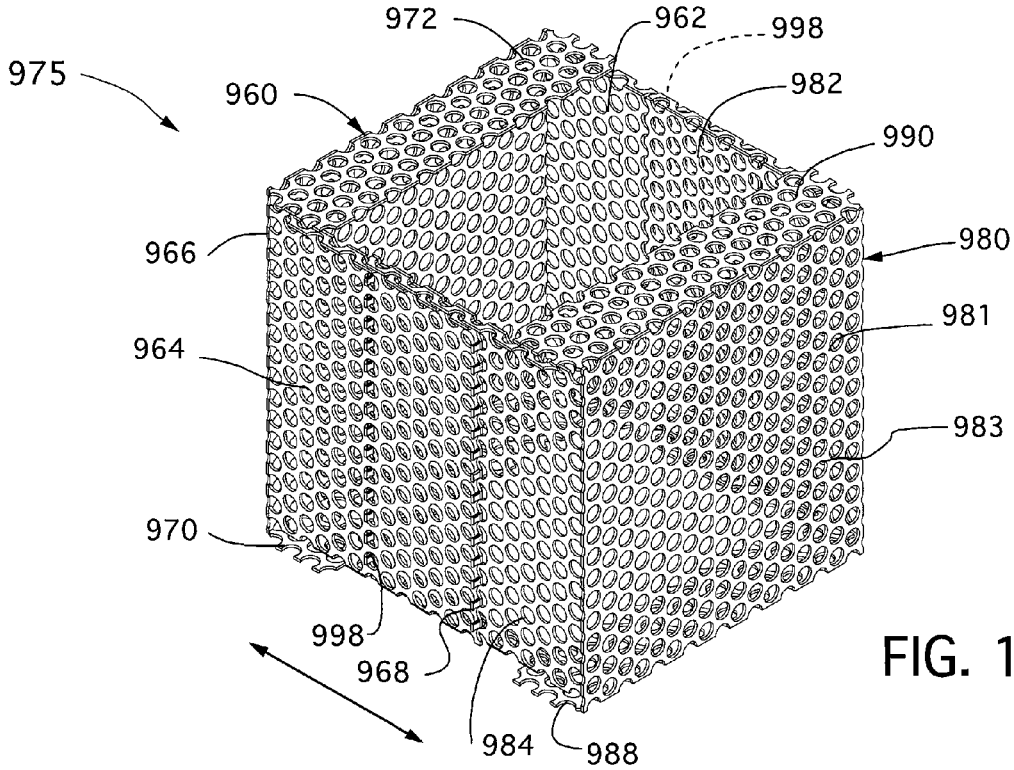
FIG. 15 is a first perspective view of a bracket formed from two of the components of FIG. 13 useful in a building module according to the present disclosure.

Another bracket useful in the building module of the present disclosure is depicted in FIG. 15 and generally referenced by the numeral 975. Bracket 975 is also shown attached to a wall 994 in FIG. 16. Bracket 975 is formed by mating two of bracket component 960 of FIG. 13. For purposes of clarity, only one of the bracket components is indicated by the numeral 960, while the mating bracket component is indicated by the numeral 980 and has a structure analogous to that of bracket 960. Bracket component 980 has a second platform 981 that bears a perforated second planar surface 983. Bracket component 980 has third and fourth overlap members 988 and 990 that are preferably integral to second platform 981 and provide additional strength and rigidity to component 980. Bracket component 980 has third and fourth sides 982 and 984 extending away from second platform 981 and second planar surface 983. Third and fourth sides 982 and 984 have third and fourth groups of protrusions 998 extending therefrom, respectively, preferably generally perpendicularly outward therefrom and the third and fourth groups of protrusions 998 extend generally away from each other. Bracket component 980 is composed of the same material as bracket component 960.

Bracket components 960 and 980 can be interlocked by pressing inward sides 962 and 964 of component 960 and inserting component 960 into component 980. Components 960 and 980 are flexible to a degree sufficient to enable them to be manipulated by hand yet provide a bracket of sufficient strength to function in a building module. Protrusions 998 of inserted component 980 interlock with orifices at sides 962 and 964 of mating component 960 to ensure interlocking of components 960 and 980.

Figure 16:
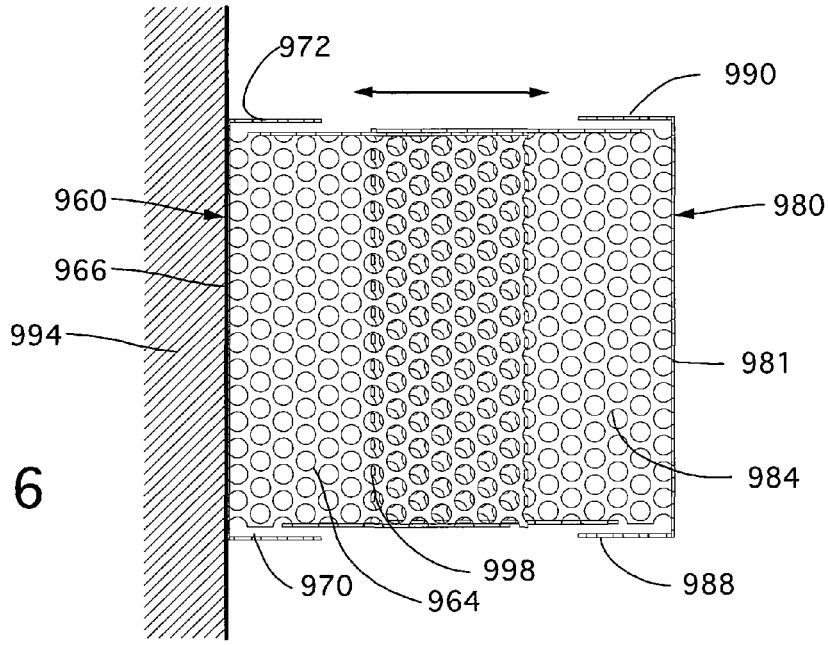
FIG. 16 is a side view of the bracket of FIG. 15 attached to a wall.

The formed bracket 975 can be affixed to wall 994 as shown in FIG. 16. Bracket 975 may be affixed by any means known in the art, such as screws, nails, and staples (not shown) using the plurality of orifices in platform 966. Alternately, adhesives may be employed.

Figure 17:
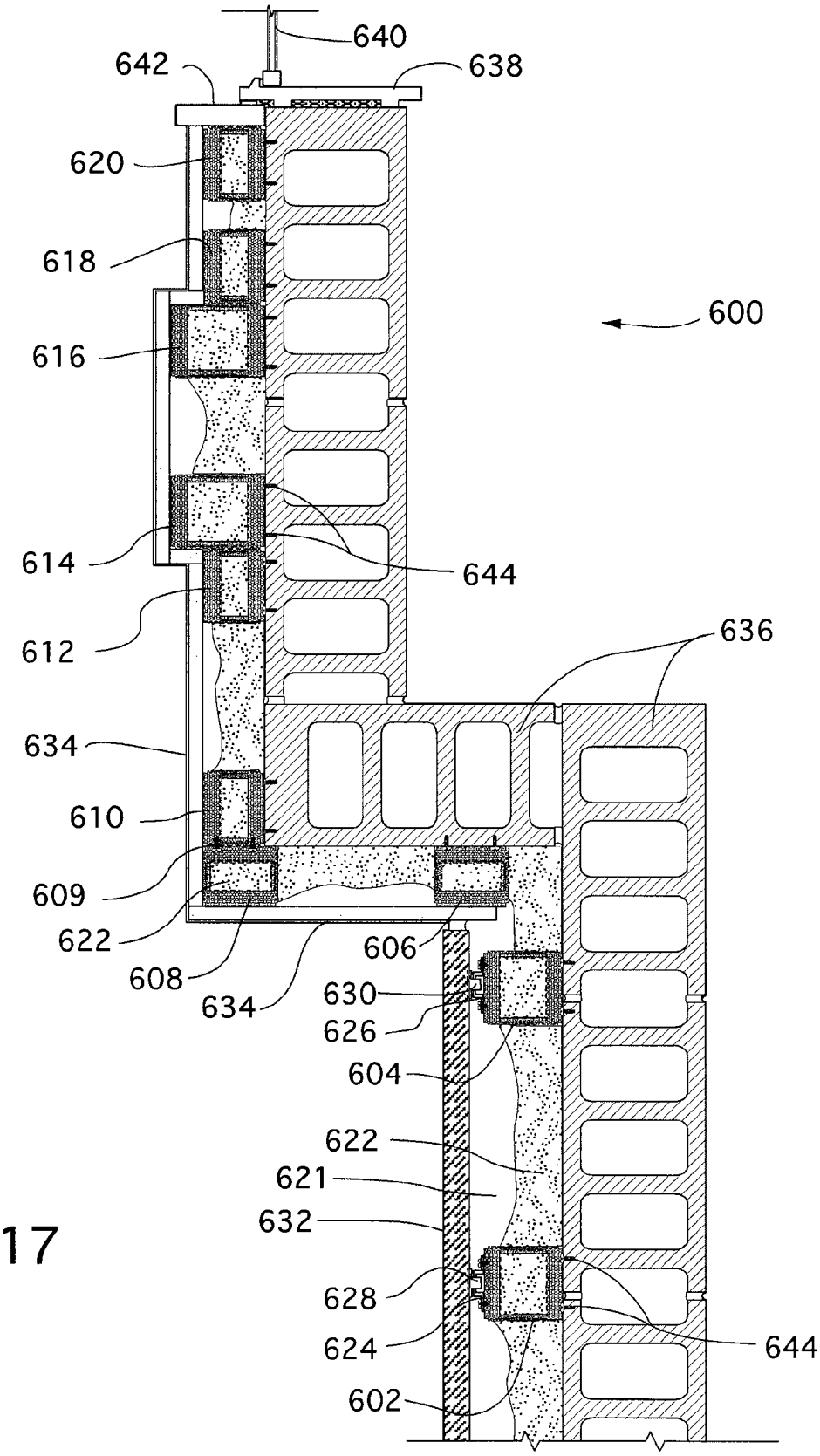
FIG. 17 is a broken, plan view of an embodiment of a building module according to the present disclosure utilizing a plurality of the bracket of the type set forth in FIG. 15.

An embodiment of a building module according to the present disclosure is depicted in FIG. 17 and generally reference by the numeral 600. Module 600 has a rigid wall of a plurality of concrete blocks 636. Module 600 has a plurality of rigid brackets 602, 604, 606, 608, 610, 612, 614, 616, 618, and 620 affixed to a concrete wall formed by a plurality of concrete blocks 636 via a plurality of screws 644. Bracket 608/610, 612/614, and 616/618 are also laterally affixed to each other. The several brackets are of the type depicted in FIG. 15. A rigid, spray foam 625 embeds at least 60% of the depth of brackets 602, 604, 606, 610, 612, 614, 616, 618, and 620 and embeds or fills 100% of the inside of the brackets. The gaps between foam 622 and exterior panels 632 and 634 take the form of airspaces 621, which function as a rainscreen and providing ventilation behind exterior panels 632 and 634. Exterior panel 632 is a heavy marble panel and is affixed to brackets 602 and 604 via male latches 628 and 630, which mate with female grooves 624 and 626 affixed to brackets 602 and 604. There is additional structure shown in FIG. 17 in the form of window 640, window jamb 638, and extension casing 642.

Figure 18:
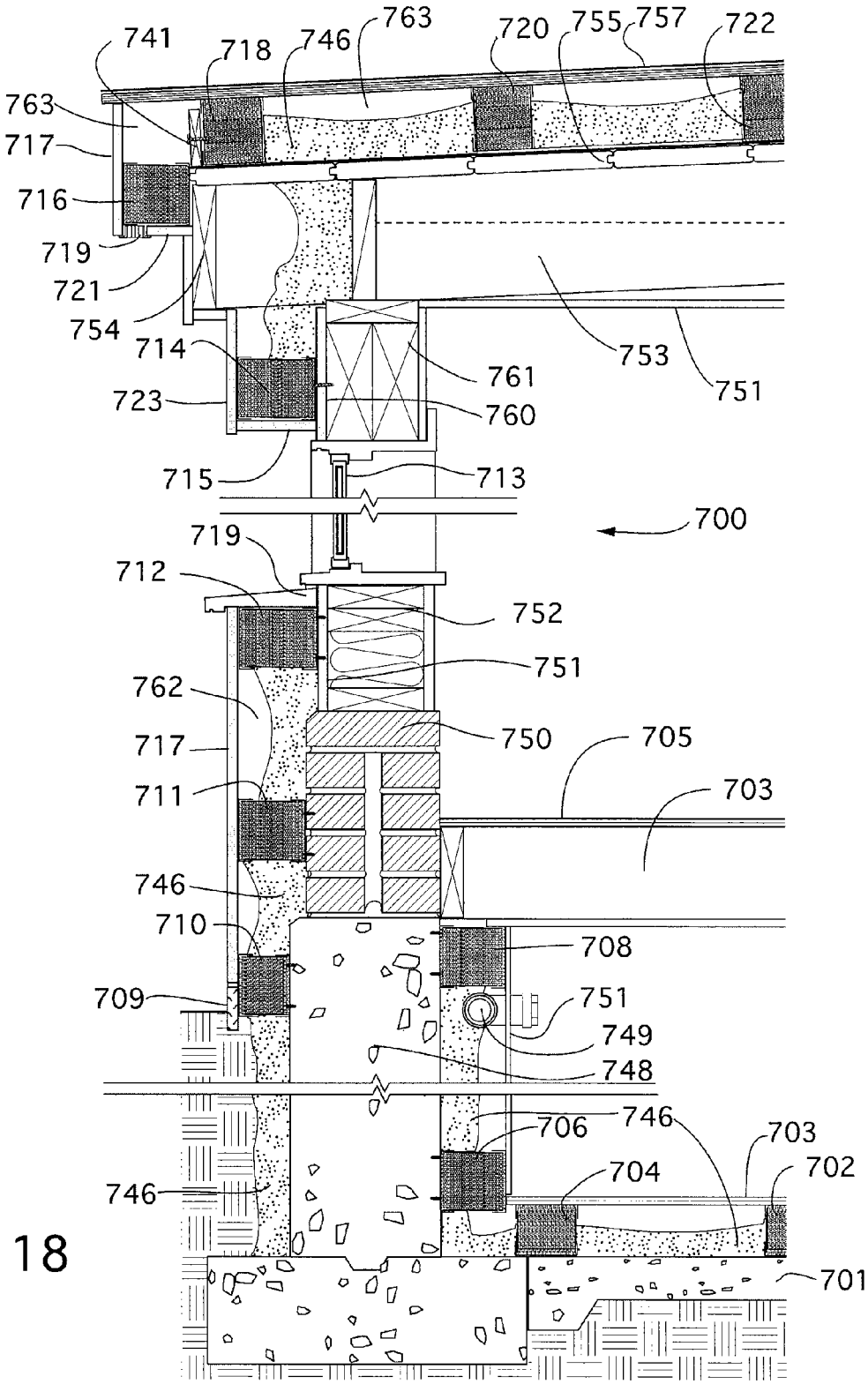
FIG. 18 is a broken, vertical section view of another embodiment of a building module according to the present disclosure utilizing a plurality of the bracket of the type set forth in FIG. 15.

An embodiment of a building module according to the present disclosure is depicted in FIG. 18 and generally referenced by the numeral 700. Module 700 has brackets 702, 704, 706, 708, 710, 711, 712, 714, 716, 718, 720, and 722. The several brackets are of the type and structure depicted in FIG. 15. The several brackets are affixed with various types of screws to planar or uneven surfaces of various construction materials. Brackets 702 and 704 elevate, level, and insulate a floor 703 above a basement slab 701 and are affixed to slab 701 via screws. Insulation and waterproofing is provided throughout module 700 by spray foam 746. Brackets 706, 708, and 710 are secured to a cement foundation 748 via screws and provide support for exterior panel 717 and interior panel 751. Bracket 711 is secured to masonry 750 via screws and provides support for panel 717. Bracket 712 is secured to interior panel 751 and optionally further to wood blocks 752 via screws or adhesive laterally to window sill 719. Bracket 714 provides support for external panel 721 and lateral support for external soffit panel 715. Bracket 714 is secured to innerpanel 760 and optionally further to wood header 761. Bracket 716 provides support for external panel 717 and lateral support for external soffit panel 723. Brackets 718, 720, and 722 provide support for roof panel 757, and bracket 718 further provides lateral support for foam stop 741. Bracket 716 is secured via screws (not shown) to rim joist 754. Vent 719 provides ventilation to the general roof structure and is considered a cold roof in the industry. The gaps between foam 746 and roof panels 757 take the form of vent space 763, and the gaps between foam 746 and the several exterior panels and structures take the form of vent space 762. The vent spaces act as a rainscreen by providing draining directly to ground below bracket 710. Building module 700 also shows a window 713 in fragment, a floor 705, a basement floor 703, a ceiling panel 751, a roof joist 753, and a plumbing pipe 749.

Figure 19:
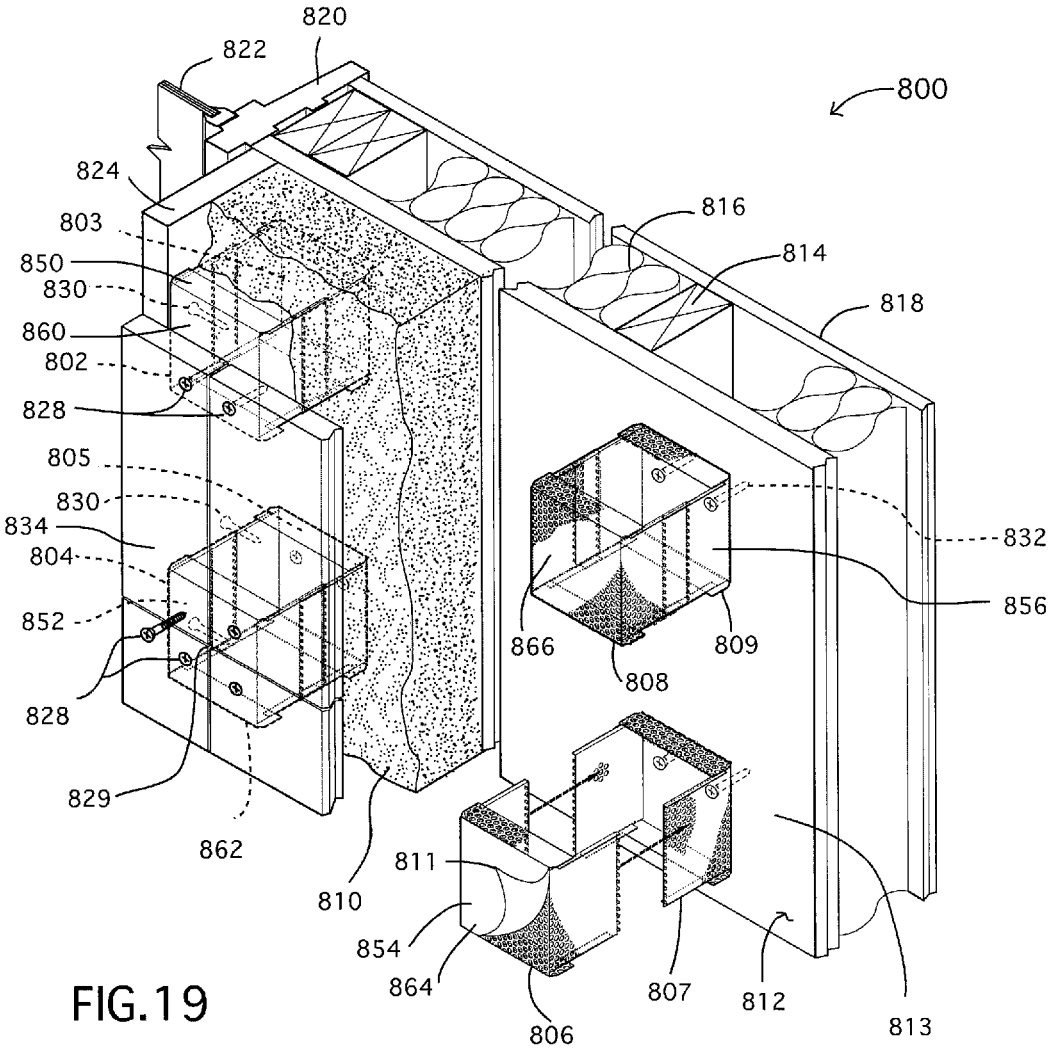
FIG. 19 is a broken, perspective view of yet another embodiment of a building module according to the present disclosure utilizing a plurality of the bracket of the type set forth in FIG. 15.

An embodiment of a building module according to the present disclosure is depicted in FIG. 19 and generally reference by the numeral 800. Module 800 has a rigid interior construction panel 812 defining a planar surface 813. Panel 812 has a plurality of rigid brackets 850, 852, 854, and 856, affixed to planar surface 813 by screws, such as by way of example with screws 832. Exterior construction panel 834 is shown in fragment as affixed to brackets 850 and 852 via screws 828. Panel 834 is also shown in four discrete sections with a point of intersection at 829. Brackets 850 and 852 are also affixed to a side window extension casing construction panel 824 via screws 830. Bracket 850, 852, 854, and 856 correspond in type and structure to bracket 975 in FIG. 15. The four brackets shown are merely illustrative of the number of brackets that can be employed. Fewer or greater numbers of brackets are possible depending on the application. Bracket 850 is made up of mating components 802 and 803. Bracket 852 is made up of mating components 804 and 805. Bracket 854 is made up of mating components 806 and 807. Bracket 856 is made up of mating components 808 and 809. Brackets 850, 852, 854, and 856, define planar surfaces 860, 862, 864, and 866 thereon, respectively, which are adapted to receive external panel 834. Bracket 854 illustrates, by way of example, the perforated structure of all of the brackets. A rigid, spray foam 810 is contiguous to and substantially covers planar surface 813 of inner panel 812 and contacts and embeds brackets 850, 852, 856, and 858 except for planar surfaces 860, 862, 864, and 866. Bracket 854 also shows be way of example a release or adhesive liner 811, which can be peeled to expose planar surface 864. Liner 811 protects planar surface 864 from being covered over or impinged by foam 810 when foam 810 is applied to planar surface 813. As an alternative to or in addition to a liner, a sheet-like barrier of a paper-based or plastic material can be placed within a bracket on the underside of the planar surface thereof. The embodiment has ancillary structure in the form of interior construction panel 818, studs 814, batt insulation 816, window jamb 820, and window 822.

Figure 20:
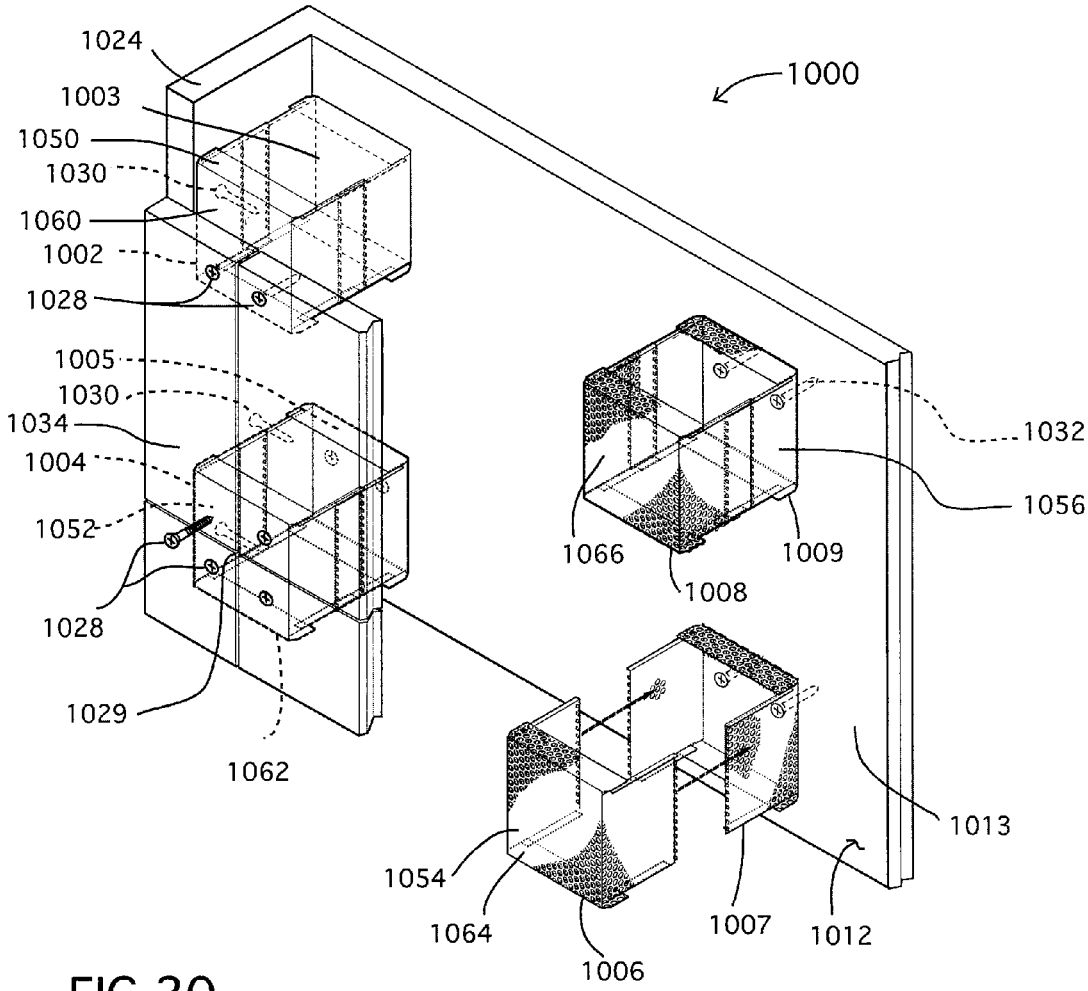
FIG. 20 is a broken, perspective view of another embodiment of a building module according to the present disclosure using a plurality of brackets of the type set forth in FIG. 15.

An embodiment of a building module according to the present disclosure is depicted in FIG. 20 and generally referenced by the numeral 1000. Module 1000 has an inner construction panel 1012 defining a planar surface 1013. Panel 1012 has a plurality of rigid brackets 1050, 1052, 1054, and 1056. Bracket 1050 is made up of mating components 1002 and 1003. Bracket 1052 is made up of mating components 1004 and 1005. Bracket 1054 is made up of mating components 1006 and 1007. Bracket 1050 is made up of mating components 1008 and 1009. Brackets 1050, 1052, 1054, and 1056 define planar surfaces 1060, 1062, 1064, and 1066 thereon, respectively, which are adapted to receive exterior panel 1034.

Brackets 1050, 1052, 1054, and 1056 are affixed to planar surface 1013 by screws 1032. Exterior panel 1034 is affixed to brackets 1050 and 1052 via screws 1028. Panel 1034 is also shown in four discrete sections with a point of intersection 1029. Brackets 1050 and 1052 are also affixed to a side panel 1024 via screws 1030. If desired, screws can be replaced by other mechanical fasteners or by adhesives. Brackets 1050, 1052, 1054, and 1056 depicted in FIG. 20 correspond in type and structure to bracket 975 in FIG. 15. The brackets disclosed in FIGS. 1A/1B, 2A/2B, and FIG. 8 may be substituted for brackets 1050, 1052, 1054, and 1056 as desired.

Module 1000 differs from other module embodiments disclosed herein in that no foam or adhesive is used to fill in brackets 1050, 1052, 1054, and 1056 or to cover the remainder of planar surface 1013. In module 1000, brackets 1050, 1052, 1054, and 1056 are used without the structural reinforcing provided structural foam or adhesives. The inherent structural rigidity of brackets 1050, 1052, 1054, and 1056 provides substantially the sole support for external panel 1034. External panel 1034 is merely illustrative of conventional construction and finishing materials and structures that can be attached to the brackets. Examples include walls, roofs, ceilings, and machine or scaffolding.

The planar, exposed face or surface of an individual bracket is typically substantially smaller than the surface of the construction panel to which it is affixed. Preferably, the planar surface of each bracket will be about 9 square inches or more. More preferably, the planar surface of each bracket will be about 16 square inches to about 25 square inches. The planar surface each of the brackets will typically be large enough to provide an area sufficiently large to provide for easy and effective application of mechanical fasteners from the exterior sheathing or finish panel into the bracket. The planar surface of the bracket will typically be small enough to avoid bracket size that is unwieldy to manipulate and to minimize insulation loss as the bracket is typically composed of a solid material that has a higher thermal conductivity than foam.

The bracket can be made of any rigid construction material. Useful materials include metals and plastics. Plastics can be formulated to be rigid and exhibit relatively low thermal conductivity compared to other materials. Useful plastics include acrylonitrile-butadiene-styrene (ABS), polypropylene, and polycarbonates. Plastic brackets can be formed by any process known in the art, such as injection molding or stamping. A useful metal is galvanized or stainless steel. Metal brackets can be formed by any process known in the art, such as stamping. Metal brackets are typically formed from metal sheet of a thickness such that it can be stamped and/or bended to form a desired configuration. Perforated metal sheet is a preferred starting material. A useful perforated metal sheet has orifices therein and therethrough such that foam can expand through the orifices to enhance immobilization of the bracket.

The spacing of brackets will vary depending on the application. In conventional applications of exterior sheathing to stud walls and masonry walls, brackets will typically be placed about 16 inches to about 24 inches apart. In module applications when heavy exterior masonry finishes are to be applied, steel brackets of larger gauge are preferably affixed to external sheathing using more fasteners. The brackets and the foam/adhesive matrix together transfer the weight of the finish material to the load bearing structure of the inner panel, e.g., a wall. The bracket allows attachment of exterior sheathing, e.g., finish panels and materials, around corners, windows, doors, columns, roof coping, and ridges. The completed module can provide an insulating, weather-resistant, water-proofing, and air-tight envelope around a building. Brackets are adjustable to plumb walls, level floors and ceilings, and slope roofs.

Any mechanical fastener known in the art may be used in the module to affix the brackets to inner structural panels, exterior sheathing or cladding, or other construction or structural surfaces. Examples of useful mechanical fasteners include screws, bolts, and staples. Alternately, adhesives such as polyurethane foam adhesives may be employed.

The interior construction panel of the module can be a new or existing wall structure. The construction panel of the module can be any rigid structural wall, floor, or roof construction material known in the art to which the bracket can be affixed. Examples of suitable inner panel materials include, but are not limited to, concrete slabs, concrete block walls, wood plank, wood frame, plywood, oriented strand board, roof shingles, tiles, metal roofs, masonry, stucco and concrete. Similarly, the outer surface panel of the module can be any exterior or interior sheathing and finish materials known in the art that can be affixed to the bracket. Examples include, but are not limited to, wood plank, plywood, cement board, stucco finish, gypsum board, masonry, stone, stucco, concrete panels, metal panels, glass, solar panels, and metal panels. Existing loosely attached siding, such as that of vinyl and aluminum, and wood shingles, should be removed to expose the structural surface below before fastening the brackets. If the building module is being constructed over structurally sound existing exterior sheathing or masonry of a building, then the existing exterior sheathing essentially functions as the interior construction panel of the new building module, which will have new sheathing or finish panels at its exterior.

The building module of the present disclosure may be used essentially anywhere in the construction of a building. The module may be used for insulating and finishing floors, walls, ceilings, and roofs. It can frame around corners, windows, doors, columns, basement pipes, and parapets.

Foams useful in the building module of the present disclosure are closed-cell, spray foams, i.e., foam-in-place and pour-in-place thermoset foams. The term "spray foam" is understood herein to be inclusive of any of the foregoing thermoset foams. Such foams are advantageous because they enhance the structural rigidity of the module, as well as provide insulation value. The foams also form a continuous air and water barrier envelope around the structure. Foams physically immobilize and structurally support the brackets and greatly reduce thermal conductivity compared to conventional construction assemblies in which insulation is between studs in walls. Studs are thermal bridges that conduct and waste heat. The foam also prevents deflection of the brackets under stress. Preferred foams are closed-cell polyisocyanurate/polyurethane foams. Preferably, the foam will have a density of about 2 to about 3 pounds per cubic foot with an R-value of 6 to 7 per inch. Preferably, the foam will exhibit a tensile strength of about 25 pounds per square inch or more and exhibit superior adhesive qualities to form permanent bonds to the inner construction surface of the module. When applied properly, spray foam will adhere to surfaces in a manner similar to adhesives. While foam thickness can vary considerably, it is particularly desirable to apply foam at least 1½ inches thick to help prevent condensation and to structurally engage and support the bracket. For most applications, a thickness of 2½ to 4½ inches is particularly desirable to provide a high level of structural strength for the brackets and the foam assembly. It is particularly desirable to embed about 70% of the depth of the bracket with foam, which provides high levels of insulation and structural strength yet provides an air gap for ventilation purposes between the foam and the outer panel. 2½ inches of foam can provide an insulation value of R-16 for walls and floors, while 3½ inches can provide R-24 for roofing applications.

Foam-in-place foams can be applied by any means known in the art, such as pouring or spraying. On a building site, spraying will usually be the preferred method of application of a partially complete module if it has already been erected or is otherwise vertically positioned. Pouring is suitable if the module is being manufactured in a flat or horizontal position for subsequent erection or placement. Preferably, the foam is applied such that it first fills the bracket then is applied to the surface of the inner panel of the modules. This will also embed a part or more of the depth of the bracket to a desired depth. Embedding to about 60% to about 90% of the depth of the bracket is preferred. When applying the foam, it may be desirable to use release paper on the planar surface of the bracket to ensure easy removal of overspray and provide a clean surface to attach exterior or finish panels. In some embodiments, it may be desirable to leave an air space between the foam and the external panel or sheathing to allow for the movement of moisture and air. In other embodiments of the module, if the external panel is installed before the foam is poured, it may be desirable to completely fill the bracket and the area surrounding it with foam as there will be the form space between the inner panel and the external panel to be filled with foam.

As an alternative to the use of insulating foams, adhesives may be used. Adhesives may be applied, e.g., sprayed or poured, onto the planar surface of the inner construction panel so as to form a matrix or layer. On a building site, spraying will usually be the preferred method of application of a partially complete module if it has already been erected or is otherwise vertically positioned. Pouring is suitable if the module is being manufactured in a flat or horizontal position for subsequent erection or placement. Preferably, the adhesive is applied such that it surrounds and embeds a major part or more of the depth of the bracket. Preferably, the adhesive is applied so that the planar, exposed surface of the bracket, i.e., the surface facing outward or away from the construction panel, is substantially free of adhesive so that there will be a clean surface against which to affix or attach exterior sheathing. Foams are preferred over adhesives since they provide greater insulation value. When applying foam or an adhesive, it may be desirable to use release paper on the planar surface of the bracket to ensure easy removal of overspray.

Useful classes of adhesives include, for example, polyurethane-based foam adhesives.

As an alternative to using insulating foams and adhesives that supplement the inherent strength of the bracket, the brackets may be used without any additional structural stiffening, providing that the bracket is within the allowable structural tolerance rating of that bracket without the improved strengthening afforded to the module assembly if the bracket was embedded with structural foams or adhesives.

When attached to a structural panel or other surfaces with appropriate fasteners and or adhesives the brackets inherent structural integrity bears the weight of any objects, within the rated capacity of the bracket design. Panels or other objects can be attached to the face plane, or to the top, bottom, or sides of the brackets. The bracket may be first fastened to a floor, or attached to a wall, roof, ceiling, machine or scaffolding. External panels are examples of one of many objects and structures that can be attached to the bracket.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances which fall within the scope of the appended claims.

What is claimed is:

1. A building module, comprising:

an inner construction panel defining a planar surface thereon;

one or more rigid brackets each affixed by one or more mechanical fasteners to the planar surface of the inner construction panel, wherein each of the one or more brackets bears a planar surface facing substantially away from the planar surface of the inner construction panel, wherein the surface area of the planar surface of each of the one or more brackets is substantially smaller than the surface area of the planar surface of the inner construction panel to which the one or more brackets is affixed; and a rigid, closed-cell, spray polyurethane foam or adhesive matrix contiguous to and substantially covering the planar surface of the inner construction panel and filling to and surround and/or embed at least a major portion of the one or more brackets, wherein the one or more brackets includes first and second slidably coextensive unitary components, wherein the first unitary component includes a back panel, a bottom ledge, and first and second side panels, wherein the back panel intersects the first and second side panels at substantially right angles, wherein the first and second side panels intersect the bottom ledge at substantially right angles, wherein the first and second side panels each have an outer surfaces, wherein the first and second side panels each have a plurality of splines protruding at their outer surface extending generally from top to bottom, wherein the back panel is flush and contiguous with respect to the planar surface of the inner construction panel, wherein the back panel is affixed to the planar surface of the inner construction panel, wherein the second unitary component includes a face panel, third and fourth side panels, and a rim, wherein the face panel intersects the third and fourth side panels at substantially right angles, wherein the rim extends around the upper edges of the face panel and the third and fourth side panels, wherein the face panel bears the planar surface of each of the one or more brackets, wherein the third and fourth side panels each have an inner surface, wherein the third and fourth side panels each have a plurality of splines protruding at their inner surface extending generally from top to bottom, wherein the plurality of splines of the first and second side panels are slidably coextensive with the splines of the third and fourth side panels.

2. The module of claim 1, wherein the foam or adhesive matrix fills and surrounds and/or embeds about 60% to about 90% of the depth of the one or more brackets.

3. The module of claim 1, wherein the one or more mechanical fasteners is a selected from the group consisting of screws, bolts, and adhesives.

4. The module of claim 1, wherein the module is a wall unit.

5. The module of claim 1, wherein the module is a ceiling unit.

6. The module of claim 1, wherein the module is a roofing unit.

7. The module of claim 1, wherein the module is a flooring unit.

8. The module of claim 1, wherein the bracket is a plastic bracket.

9. The module of claim 1, wherein the bracket is a metal bracket.

10. The module of claim 1, wherein the bracket is adjustable to accommodate and plumb walls, level floors and ceilings, and slope roofs.

11. The module of claim 1, wherein the inner construction panel is of a material is selected from the group consisting of wood plank, glass, metals, plywood, oriented strand board, particle board, fiberboard, hardboard, gypsum board, masonry, brick, stucco and concrete.

12. The module of claim 1, further comprising an external construction panel affixed to the planar surface(s) of the one or more brackets.

13. The module of claim 12, wherein the foam or adhesive matrix and the planar surface of each of the one or more brackets define a ventilation air gap between the foam and an external panel.

14. The module of claim 1, wherein the surface area of the planar surface of each of the one or more brackets is about 4 square inches or more.

15. The module of claim 1, wherein the surface area of the planar surface of each of the one or more brackets is about 9 square inches or more.

16. The module of claim 1, wherein the surface area of the planar surface of each of the one or more brackets is about 9 square inches to about 25 square inches.

17. A method for constructing a building, comprising: joining a plurality of the building modules of claim 1.

18. The module of claim 1, wherein the module includes the rigid, closed-cell, spray polyurethane foam.

19. A method for making a building module, comprising:

(a) affixing one or more rigid brackets to a planar surface of an rigid inner construction panel by one or more mechanical fasteners, wherein the one or more brackets each bears a planar surface facing substantially away from the planar surface of the inner construction panel, wherein the surface area of the planar surface of the one or more brackets is substantially smaller than the surface area of the planar surface of the inner construction panel to which it is affixed; and (b) applying a rigid, closed-cell, spray polyurethane foam or adhesive contiguous to substantially cover the planar surface of the inner construction panel and fill and surround and/or embed at least a major portion of the one or more brackets, wherein the one or more brackets includes first and second slidably coextensive unitary components, wherein the first unitary component includes a back panel, a bottom ledge, and first and second side panels, wherein the back panel intersects the first and second side panels at substantially right angles, wherein the first and second side panels intersect the bottom ledge at substantially right angles, wherein the first and second side panels each have an outer surfaces, wherein the first and second side panels each have a plurality of splines protruding at their outer surface extending generally from top to bottom, wherein the back panel is flush and contiguous with respect to the planar surface of the inner construction panel, wherein the back panel is affixed to the planar surface of the inner construction panel, wherein the second unitary component includes a face panel, third and fourth side panels, and a rim, wherein the face panel intersects the third and fourth side panels at substantially right angles, wherein the rim extends around the upper edges of the face panel and the third and fourth side panels, wherein the face panel bears the planar surface of each of the one or more brackets, wherein the third and fourth side panels each have an inner surface, wherein the third and fourth side panels each have a plurality of splines protruding at their inner surface extending generally from top to bottom, wherein the plurality of splines of the first and second side panels are slidably coextensive with the splines of the third and fourth side panels.

20. The method of claim 19, wherein surface area of the planar surface of each of the one or more brackets is about 9 square inches to about 25 square inches.

21. The method of claim 19, wherein the method applies the rigid, closed-cell, spray polyurethane foam.

22. A bracket, comprising: first and second slidably coextensive unitary components, wherein the first unitary component includes a back panel, a bottom ledge, and first and second side panels, wherein the back panel intersects the first and second side panels at substantially right angles, wherein the first and second side panels intersect the bottom ledge at substantially right angles, wherein the first and second side panels each have an outer surfaces, wherein the first and second side panels each have a plurality of splines protruding at their outer surface extending generally from top to bottom, wherein the back panel is flush and contiguous with respect to the planar surface of the inner construction panel, wherein the back panel is affixed to the planar surface of the inner construction panel, wherein the second unitary component includes a face panel, third and fourth side panels, and a rim, wherein the face panel intersects the third and fourth side panels at substantially right angles, wherein the rim extends around the upper edges of the face panel and the third and fourth side panels, wherein the face panel bears the planar surface of each of the one or more brackets, wherein the third and fourth side panels each have an inner surface, wherein the third and fourth side panels each have a plurality of splines protruding at their inner surface extending generally from top to bottom, wherein the plurality of splines of the first and second side panels are slidably coextensive with the splines of the third and fourth side panels.

23. A building module, comprising:

an inner construction panel defining a planar surface thereon, one or more rigid brackets each affixed by one or more mechanical fasteners to the planar surface of the construction panel, wherein each of the one or more brackets bears a planar surface facing substantially away from the planar surface of the construction panel, wherein the surface area of the planar surface of each of the one or more brackets is substantially smaller than the surface area of the planar surface of the construction panel to which the one or more brackets is affixed; and an exterior panel affixed to the planar surface of each of the one or more brackets, wherein the one or more brackets is substantially free of a rigid structural foam or an adhesive matrix, wherein the one or more brackets is a plurality of the bracket set forth in claim 22.

24. The bracket of claim 22, wherein surface area of the planar surface of each of the one or more brackets is about 9 square inches to about 25 square inches.

25. The module of claim 23, wherein surface area of the planar surface of each of the one or more brackets is about 9 square inches to about 25 square inches.

* * * * *